US005742261A

United States Patent [19]

Yuki et al.

[11] Patent Number: 5,742,261

[45] Date of Patent: Apr. 21, 1998

[54] DISPLAY CONTROL APPARATUS AND DISPLAY DEVICE WITH SAMPLING FREQUENCY CONTROL FOR OPTIMIZING IMAGE SIZE

[75] Inventors: Osamu Yuki, Atsugi; Hiroshi Inoue, Yokohama, both of Japan

[73] Assignee: Canon Kabushiki Kaisha, Tokyo, Japan

[21] Appl. No.: 319,480

[22] Filed: Oct. 7, 1994

Related U.S. Application Data

[63] Continuation of Ser. No. 899,606, Jun. 16, 1992, abandoned.

[30] Foreign Application Priority Data

Jun. 21, 1991 [JP] Japan ..... 3-150324

[51] Int. Cl.[6] ..... G09G 5/00

[52] U.S. Cl. ..... 345/3; 345/132

[58] Field of Search ..... 340/701, 703, 340/793, 784, 716, 717, 814; 358/236, 241, 183; 345/87, 88, 150, 147, 1, 4

[56] References Cited

U.S. PATENT DOCUMENTS

| | | | |
|---|---|---|---|
| 4,804,951 | 2/1989 | Yamashita et al. | 345/92 |
| 4,841,289 | 6/1989 | Kambayashi et al. | 345/150 |
| 4,922,241 | 5/1990 | Inoue et al. . | |
| 4,926,166 | 5/1990 | Fujisawa et al. | 345/3 |
| 4,962,376 | 10/1990 | Inoue et al. . | |
| 4,970,588 | 11/1990 | Kobayashi | 358/183 |
| 4,970,596 | 11/1990 | Johnson | 358/183 |
| 4,998,100 | 3/1991 | Ishii | 340/814 |
| 5,087,976 | 2/1992 | Oda et al. | 358/183 |

FOREIGN PATENT DOCUMENTS

| | | |
|---|---|---|
| 0260329 | 3/1988 | European Pat. Off. . |
| 0343539 | 5/1988 | European Pat. Off. . |
| 0344621 | 12/1989 | European Pat. Off. . |
| 0400286 | 12/1990 | European Pat. Off. . |
| 0421772 | 4/1991 | European Pat. Off. . |
| 0464555 | 1/1992 | European Pat. Off. . |
| 0479508 | 4/1992 | European Pat. Off. . |
| 3836558 | 5/1990 | Germany . |

*Primary Examiner*—Chanh Nguyen

*Attorney, Agent, or Firm*—Fitzpatrick, Cella, Harper & Scinto

[57] ABSTRACT

A display control apparatus which controls with a ferroelectric liquid crystal display device. A continuous system analog primary image signal is thinned and converted to a digital image signal by the display control apparatus. The digital image signal is then displayed on the ferroelectric liquid crystal display device.

6 Claims, 20 Drawing Sheets

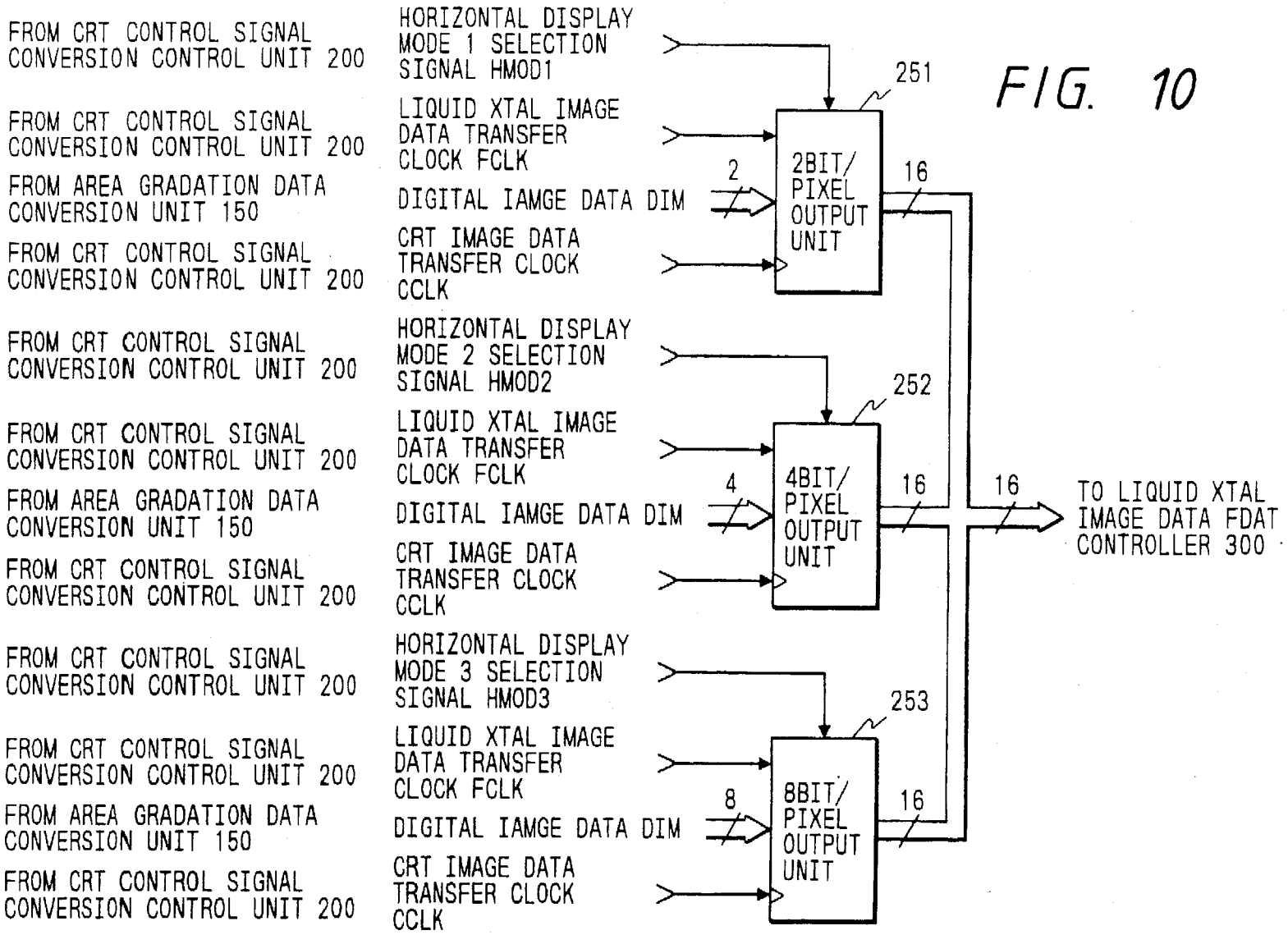
FIG. 10
251
2BIT/ PIXEL OUTPUT UNIT
252
4BIT/ PIXEL OUTPUT UNIT
253
8BIT/ PIXEL OUTPUT UNIT
16
2
4
8
DIM
TO LIQUID XTAL IMAGE DATA FDAT CONTROLLER 300
HORIZONTAL DISPLAY MODE 1 SELECTION SIGNAL HMOD1
LIQUID XTAL IMAGE DATA TRANSFER CLOCK FCLK
DIGITAL IAMGE DATA
CRT IMAGE DATA TRANSFER CLOCK CCLK
HORIZONTAL DISPLAY MODE 2 SELECTION SIGNAL HMOD2
HORIZONTAL DISPLAY MODE 3 SELECTION SIGNAL HMOD3
FROM CRT CONTROL SIGNAL CONVERSION CONTROL UNIT 200
FROM AREA GRADATION DATA CONVERSION UNIT 150

HORIZONTAL DISPLAY MODE 1 SELECTION SIGNAL HMOD 1

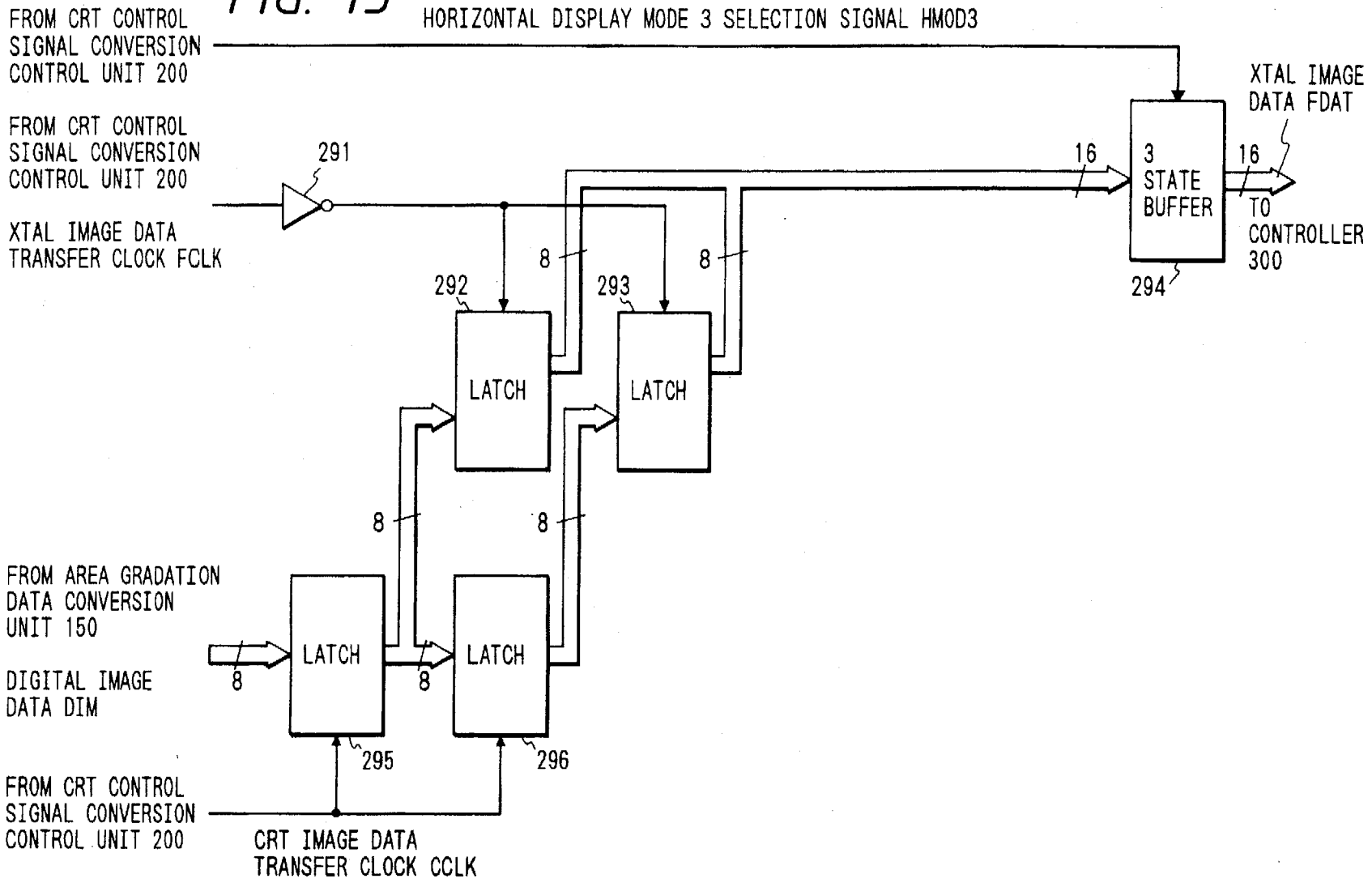
FIG. 13
HORIZONTAL DISPLAY MODE 3 SELECTION SIGNAL HMOD3
FROM CRT CONTROL SIGNAL CONVERSION CONTROL UNIT 200
FROM CRT CONTROL SIGNAL CONVERSION CONTROL UNIT 200
XTAL IMAGE DATA TRANSFER CLOCK FCLK
291
3 STATE BUFFER
294
16
XTAL IMAGE DATA FDAT
16
TO CONTROLLER 300
LATCH
292
LATCH
293
LATCH
295
LATCH
296
8
8
8
8
8
8
FROM AREA GRADATION DATA CONVERSION UNIT 150
DIGITAL IMAGE DATA DIM
FROM CRT CONTROL SIGNAL CONVERSION CONTROL UNIT 200
CRT IMAGE DATA TRANSFER CLOCK CCLK

FIG. 16

| MODE | CRT PIXEL | NUMBER OF DISPLAY COLORS |
|---|---|---|
| $0^+$, $1^+$ | 360 * 400 | 4 |
| $2^+$, $3^+$ | 720 * 400 | 4 |
| $7^+$ | 720 * 400 | MONO |
| 4 , 5 | 320 * 200 | 4 |
| 6 | 640 * 200 | 2 |
| D | 320 * 200 | 16 |
| E | 640 * 200 | 16 |
| F | 640 * 350 | 4 |
| 10 | 640 * 350 | 16 |
| 11 | 640 * 480 | 2 |
| 12 | 640 * 480 | 16 |
| 13 | 320 * 200 | 256 |

| V SYNC SIGNAL | H SYNC SIGNAL | VERTICAL DIRECTION DISPLAY LINE |
|---|---|---|
| NEGATIVE POLARITY | POSITIVE POLARITY | 350 LINE |
| POSITIVE POLARITY | NEGATIVE POLARITY | 400 LINE |
| NEGATIVE POLARITY | NEGATIVE POLARITY | 480 LINE |

FIG. 18

| | V SYNC (LINE) | | H SYNC (CCLK CLOCK) | |
|---|---|---|---|---|
| MODE | FRONT PORCH START | BACK PORCH END | FRONT PORCH START | BACK PORCH END |
| 0+, 1+ | 437 | 37 | 778 | 48 |
| 2+, 3+ | 437 | 37 | 778 | 48 |
| 7+ | 437 | 37 | 778 | 48 |
| 4 , 5 | 437 | 37 | 778 | 48 |
| 6 | 437 | 37 | 778 | 48 |
| D | 437 | 37 | 778 | 48 |
| E | 437 | 37 | 778 | 48 |
| F | 412 | 62 | 778 | 48 |
| 10 | 412 | 62 | 778 | 48 |
| 11 | 515 | 35 | 778 | 48 |
| 12 | 515 | 35 | 778 | 48 |
| 13 | 437 | 37 | 778 | 48 |

FIG. 19

| AREA GRADATION DATA ROM ADDRESS | (MSB) AREA GRADATION DATA (LSB) |
|---|---|
| 00 (h)~20 (h) | 0 0 0 0 |
| 21 (h)~40 (h) | 0 0 1 0 |
| 41 (h)~60 (h) | 1 0 1 0 |
| 61 (h)~80 (h) | 0 1 1 0 |
| 81 (h)~A0 (h) | 0 1 0 1 |
| A1 (h)~C0 (h) | 1 1 1 0 |
| C1 (h)~E0 (h) | 1 1 0 1 |
| E1 (h)~FF (h) | 1 1 1 1 |

DISPLAY CONTROL APPARATUS AND DISPLAY DEVICE WITH SAMPLING FREQUENCY CONTROL FOR OPTIMIZING IMAGE SIZE

This application is a continuation of application Ser. No. 07/899,606 filed Jun. 16, 1992, now abandoned.

BACKGROUND OF THE INVENTION

1. Field of the Invention

The present invention relates to a display control apparatus and, more particularly, to a display device of a ferroelectric liquid crystal device, and a display control apparatus applied to the display device.

2. Related Background Art

A CRT (Cathode Ray Tube) is known as a display device for a personal computer (to be referred to as a PC hereinafter) and a workstation (to be referred to as a WS hereinafter). In recent years, however, liquid crystal display devices having a TN (Twisted Nematic) or STN (Super Twisted Nematic) structure have been used for a laptop PC or the like in favor of a lightweight, low-profile arrangement.

A popular exiting PC or the like has various graphic modes depending on the screen sizes and the numbers of display colors. A display device for displaying information in a plurality of modes cannot perform a display operation if the device does not have a size suitable for an available display area having a specific number of pixels. For this reason, "Multisync" series products available from NEC. CORP. are known to display graphic modes having different horizontal and vertical sync signals in a size appropriate for the screen of a conventional CRT display. However, a conventional liquid crystal display performs display in a mode suitable for the number of pixels of the available display screen or a mode having a number of pixels close thereto, which is selected from different modes.

Under these circumstances, when a PC or WS CRT display control apparatus is used in combination with a liquid crystal display device by effectively using resources, many problems arise.

The popular PC has many graphic modes. Each graphic mode has a specific display size and/or a specific number of display colors. These different graphic modes may cause a poor appearance on the screen when they are directly applied to a display device having a specific available display size. For example, in a given display mode, a smaller display size than the available display area of a display device may be undesirably set. The sizes of the border areas in the upper and lower portions in the vertical direction or in the right and left portions of the horizontal direction may become different from each other. In this manner, problems associated with the display screen are left unsolved.

SUMMARY OF THE INVENTION

It is an object of the present invention to provide a display control apparatus and a display device which can solve the conventional problems described above.

It is another object of the present invention to provide a display control apparatus suitable for gradation display in a ferroelectric liquid crystal display device.

According to a first aspect of the present invention, there is provided a display control apparatus comprising:

a. first means for converting a continuous system analog primary color signal (e.g., an analog primary color signal having gradation information) into a digital signal; and b. second means for controlling the first means so that the analog primary color signal is thinned or interpolated and converted into a digital signal.

According to a second aspect of the present invention, there is provided a display control apparatus comprising:

a. first means for converting a continuous system analog primary color signal (e.g., an analog primary color signal having gradation information) into a digital signal; and b. second means for selecting a period of conversion of the analog primary color signal into a digital signal.

According to a third aspect of the present invention, there is provided a display device, comprising:

a. first means for converting a continuous system analog primary color signal into a digital signal;

b. second means for controlling the first means so that the analog primary color signal is thinned or interpolated and converted into a digital signal;

c. display means for displaying an image in response to an input of the digital signal; and d. third means for controlling the display means so that a border of the image is processed.

According to a fourth aspect of the present invention, there is provided a display device comprising:

a. first means for converting a continuous system analog primary color signal into a digital signal;

b. second means for selecting a period of conversion of the analog primary color signal into a digital signal;

c. display means for displaying an image in response to an input of the digital signal; and d. third means for controlling the display means so that a border of the image is processed.

BRIEF DESCRIPTION OF THE DRAWINGS

FIG. 10 is a block diagram of an output control unit used in the present invention;

FIG. 13 is a circuit diagram of an 8 bit/pixel output control unit used in the present invention;

FIG. 16 is a diagram used for explaining a graphic adapter 0–13H mode used in the present invention;

FIG. 18 is a diagram used for explaining values which are used in the present invention to set the horizontal and vertical frontporch starts and the horizontal and vertical backporch ends so as to generate a display timing for the liquid crystal;

FIG. 19 is a diagram used for explaining 4 bit/pixel area gradation ROM data used in the present invention;

DETAILED DESCRIPTION OF THE PREFERRED EMBODIMENTS

According to the present invention, when an analog CRT luminance signal is displayed on a ferroelectric liquid crystal display device having a bistable function, it can be displayed at an optimal position in an optimal size on the display device. For example, when a graphic mode having a display size of 720×400 is displayed on a liquid crystal device having 1,280×1,024 pixels, it is displayed in a very small region at the upper left corner of the screen. In this case, image data of 640×400 can be obtained by thinning of the image data if the ratio of the conversion period into the digital signal to the transfer period of the analog image data is selected to be 8/9. The image data is multiplied with $2^1$ at the output control unit and displayed on the display device as image data of 1,280×800. Border area control in the scan direction is performed such that border areas of equal sizes, i.e., 112 lines are formed in the upper and lower portions, respectively, of the screen.

(1) General Description of Apparatus
(2) General Description of Display Control
(3) Arrangements of Respective Parts of Display Control Apparatus
(3.1) Analog Primary Color Signal Arithmetical Operation Unit
(3.1.1) Arrangement of Analog Arithmetical Operation Circuit
(3.2) Area Gradation Data Conversion Unit
(3.2.1) Circuit Arrangement of Data Conversion Unit
(3.3) Conversion Unit for Converting CRT Control Signal into Ferroelectric Liquid crystal Display Signal
(3.3.1) Circuit Arrangement of Mode Decision Circuit
(3.3.2) Circuit Arrangement of Liquid crystal display Timing Generator
(3.3.3) Circuit Arrangement of Signal Skewing Unit
(3.4) Output Pixel Data Control Unit
(3.4.1) Circuit Arrangement of "2 Bit/Pixel" Output Unit
(3.4.2) Circuit Arrangement of "4 Bit/Pixel" Output Unit
(3.4.3) Circuit Arrangement of "8 Bit/Pixel" Output Unit
(4) Modification
(4.1) Gradation Conversion Unit
(4.2) Control Timing Generator
(4.3) Pixel Data Output Control Unit

(1) General Description of Apparatus

Figure 1:
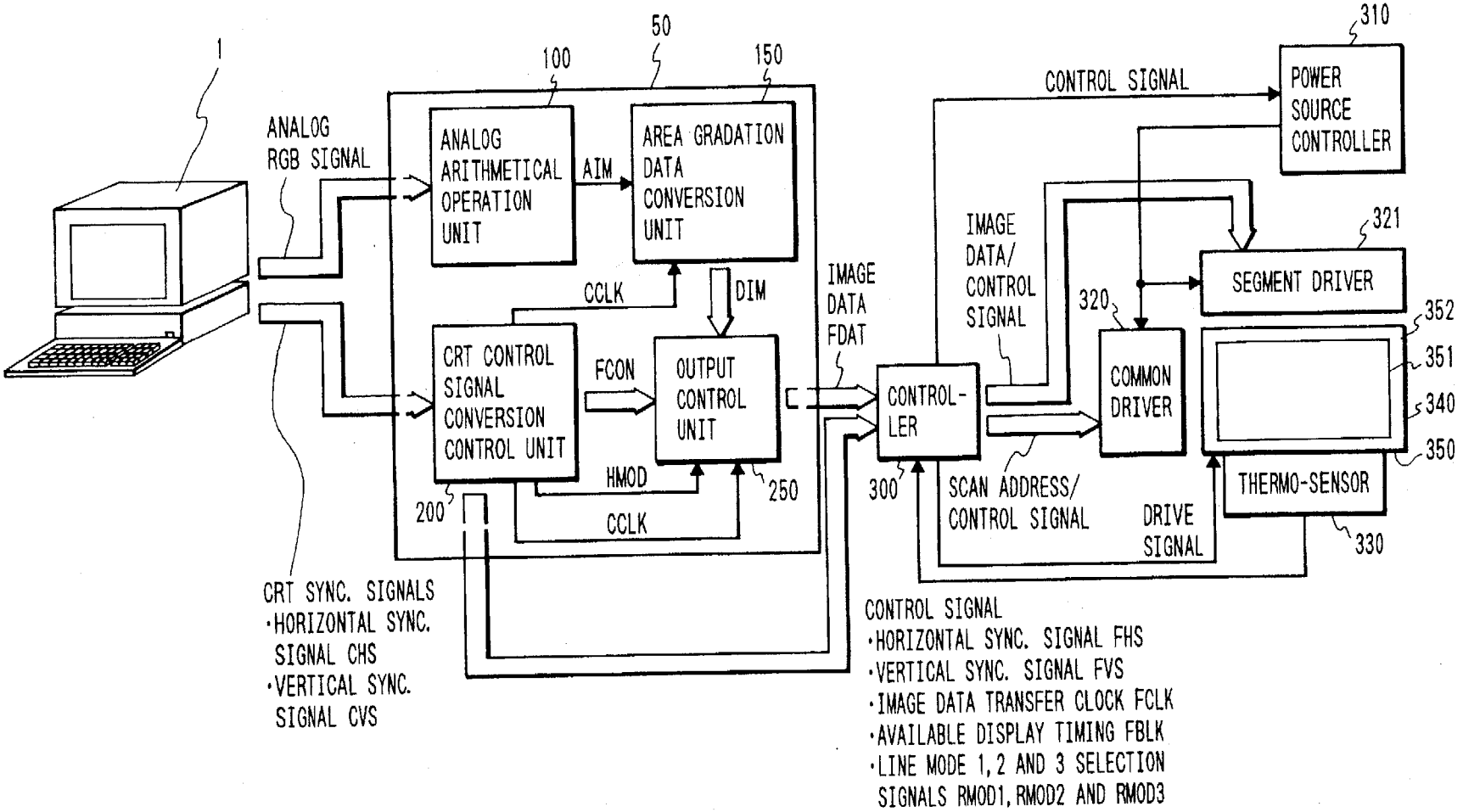
FIG. 1 is a block diagram of an apparatus according to an embodiment of the present invention.
Figure 17:
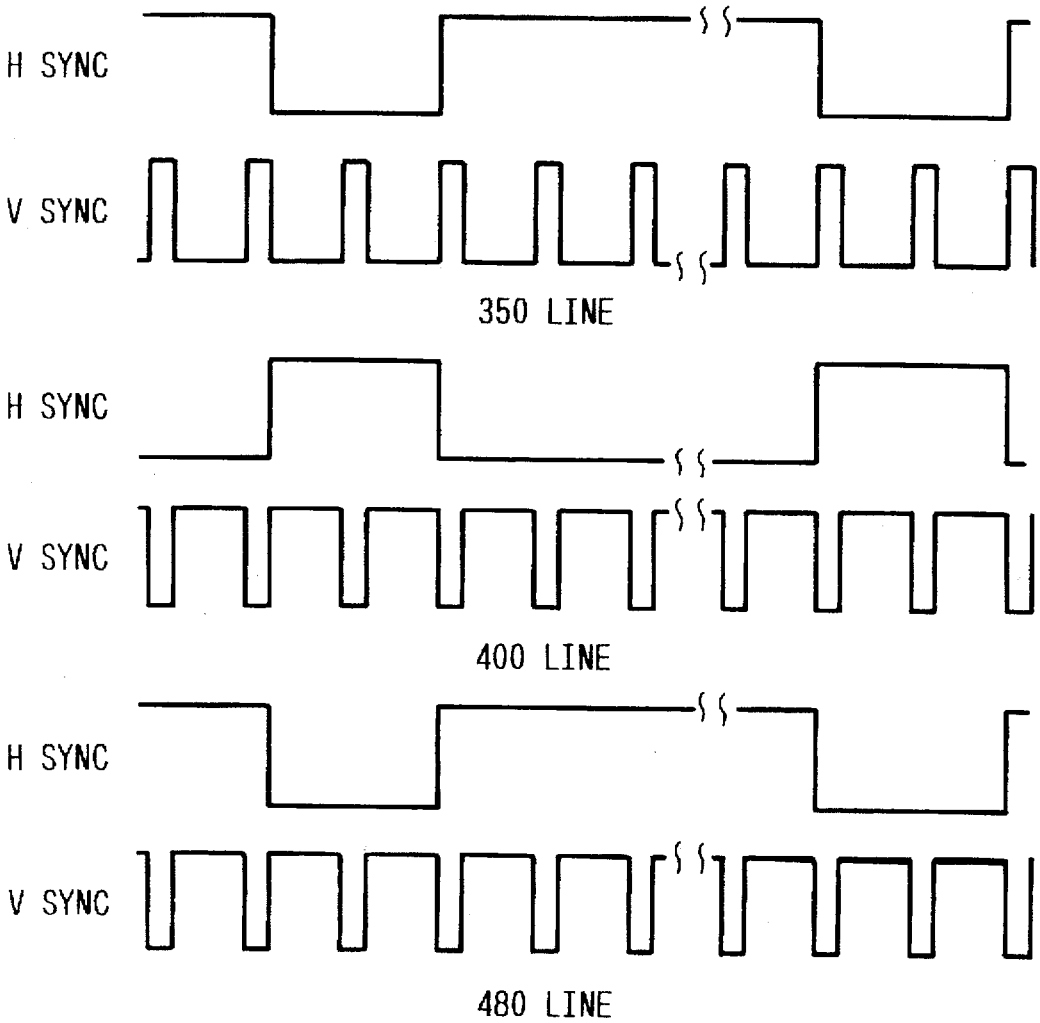
FIG. 17 is a diagram used for explaining a decision condition in accordance with display line number polarities of horizontal and vertical sync signals used in the present invention.

An embodiment of the present invention is shown in FIG. 1. A graphic adapter connected to an expansion BUS of a personal computer 1 supplies analog R, G, and B image data, a horizontal sync signal CHS, and a vertical sync signal CVS. The graphic adapter used in the computer 1 of this embodiment has many modes in accordance with the display sizes and the numbers of display colors, as shown in FIG. 16. The polarities of the horizontal and vertical sync signals CHS and CVS can discriminate the display line number in each CRT display to produce a line mode 1 selection signal RMOD1, a line mode 2 selection signal RMOD2, and a line mode 3 selection signal RMOD3, as shown in FIG. 17. A display control apparatus 50 comprises functional blocks 100, 150, 200, and 250. The display control apparatus 50 controls conversion of the analog R, G, and B signals and the CRT display control signals CHS and CVS supplied from the PC 1 and supplies digital pixel data FDAT having a format suitable for ferroelectric LC display of this embodiment and control signals (i.e., a horizontal sync signal FHS, a vertical sync signal FHV, a display timing signal FBLK, and a pixel data transfer clock signal FCLK) to a controller 300. The controller 300 supplies a control signal representing driving of one scanning line or a plurality of scanning lines of the ferroelectric LC display device to a common driver 320 and image data to a segment driver 321 in accordance with the line mode 1 selection signal RMOD1, the line mode 2 selection signal RMOD2, or the line mode 3 selection signal RMOD3. The controller 300 also controls driving of a frame 352 of the display screen. A thermosensor 330 is arranged at an appropriate position of a display unit 340 and supplies temperature information which is very important in driving of the ferroelectric LC to the controller 300. A power source controller 310 appropriately voltage-transforms signals set by the controller 300 and generates voltages which are applied to the electrodes of the display unit 340 by the display drivers 320 and 321. The display unit 340 is a display device body. In the display unit 340, a ferroelectric liquid crystal having a bistable state is sealed between two glass plates having scanning line extraction electrodes, information extraction electrodes, and transparent electrodes made of ITO or the like and connected to the extraction electrodes. A polarizer is located above the resultant structure to obtain the display unit 340. Pixels are constituted by 1024×2560 dots defined by 1,024 scanning line electrodes and 2,560 information line electrodes. Each pixel is driven by an electric field generated by drive waveforms supplied to the segment driver 321 and the common driver 320 and is displayed in a "bright" or "dark" state. The components 310, 330, and 352, and the like are described in detail in U.S. Pat. Nos. 4,922,241 and 4,962,376 to Inoue et al.

(2) General Description of Display Control

The analog arithmetical operation unit 100 in the display control apparatus 50 performs multiplications and additions of the analog R, G, and B signals supplied from the personal computer 1. Arithmetical operation precision should be determined in accordance with the numbers of displayable gradation levels and colors of the ferroelectric liquid crystal, and its upper limit is determined in accordance with the number of pixels of the liquid crystal and errors and the like of integrated circuit elements used in analog arithmetical operations to be described later. The area gradation data conversion unit 150 has an integrated circuit for converting a continuous signal into a discrete signal so as to control calculation results of the analog signal in accordance with the digital logic. A latch circuit is arranged in the area gradation data conversion unit 150 to hold data at a leading edge of the CRT image data transfer clock. The area gradation data conversion unit 150 generates area gradation data DIM by using the upper bits of the digital data from the latch circuit as an address for a read-only memory (to be referred to as a ROM hereinafter). Precision required for conversion (i.e., the number of output bits) should be determined in accordance with the number of displayable gradation levels or colors of the ferroelectric liquid crystal in the same manner as in the analog arithmetical operation unit. The upper limit of this precision is determined in accordance with the number of pixels of the liquid crystal display device, an A/D conversion scheme (to be described later), or errors of integrated circuit elements used in conversion. The CRT control signal conversion control unit 200 generates ferroelectric liquid crystal display control signals (i.e., the liquid crystal vertical sync signal FVS, the liquid crystal horizontal sync signal FHS, the liquid crystal image data transfer clock FCLK, and the liquid crystal display timing signal FBLK) from the reference control signals used in CRT display. A CRT image data transfer clock CCLK newly generated by the control unit 200 is also included in the control signals. When the period of the clock CCLK is changed to perform interpolation or thinning of the image data, a best number of pixels for the display unit 340 can be obtained. The output control unit 250 fills a plurality of pixels in a data string in units of pixels, i.e., the digital image data DIM produced by the area gradation data conversion unit 150, in accordance with a horizontal display magnification selected by the line mode 1 selection signal RMOD1, the line mode 2 selection signal RMOD2, or the line mode 3 selection signal RMOD3. The digital image data is supplied to the controller 300 in a word length consisting of a plurality of pixels for assuring the processing time of the controller 300. By this control, the display screen of the CRT display device can be displayed in a size suitable for the ferroelectric LC display device having 2,580×1,024 pixels, as in the case in FIG. 14.

(3) Arrangements of Respective Parts of Display Control Apparatus

Problems posed by ferroelectric LC display using CRT display reference signals and functions of the respective blocks will be described below. The display operation in the liquid crystal apparatus can be optimally performed by a combination of these functional blocks.

(3.1) Analog Primary Color Signal Arithmetical Operation Unit

In this embodiment, the number of pixels of the ferroelectric liquid crystal display device is 1,024 (scanning line electrodes)×2,560 (information line electrodes). The display device performs area gradation display in units of pixels each constituted by a pair of dots having a ratio of 3:2 or a plurality of such pairs. To the contrary, the arithmetical operation unit provides a means for converting CRT analog R, G, and B signals for luminance gradation into signals for area gradation. This conversion formula is "(RED Signal Value)×1+(Green Signal Value)×2+(Blue Signal Value)×0.5", i.e., an addition of weighted color component values. In this embodiment, an operational amplifier IC is used in this arithmetical operation circuit. The arithmetical operation circuit is not limited to this arrangement, but can be constituted using transistors, field effect transistors, or MOS transistors. In this case, however, base-emitter voltages, and resistances present in the base and emitter must be matched with each other to obtain necessary precision and a necessary frequency band. An operational amplifier arrangement is required to realize a high-speed, high-precision arithmetical operation. In a voltage feedback operational amplifier, the practical frequency band is limited when the gain is to be increased by the gain of a closed loop. However, the input bias voltage can be set low by a process such as dielectric isolation. In this sense, a voltage drop error (i.e., a current offset error) caused by a current flow upon application of the input bias voltage is very small. A current feedback operational amplifier is suitable for a high-speed, high-gain operation because the gain bandwidth which poses a problem in the voltage feedback operational amplifier is not limited. However, another problem is posed such that a bias current input to the noninverting input is larger than that to the inverting input because of the unbalanced input structure of the IC. However, the bias current can be controlled with high precision in consideration of the impedance of an input signal. In this embodiment, a voltage feedback operational amplifier having excellent linear characteristics is selected.

The analog primary color signal conversion unit using the voltage feedback operational amplifier will be described in detail below.

(3.1.1) Circuit Arrangement of Analog Arithmetical Operation Unit

Figure 2:
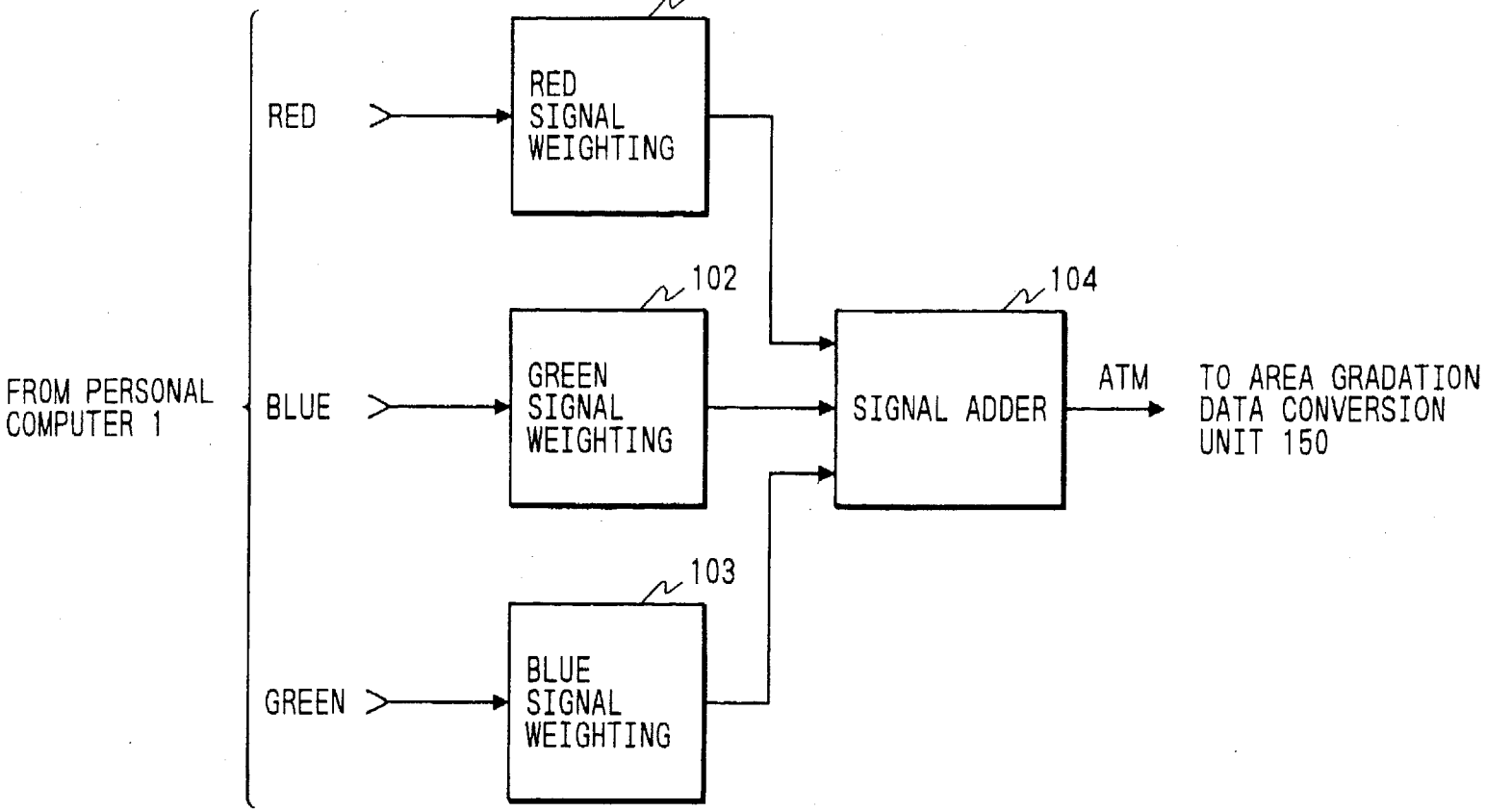
FIG. 2 is a block diagram of an analog arithmetical operation unit used in the present invention.
Figure 3:
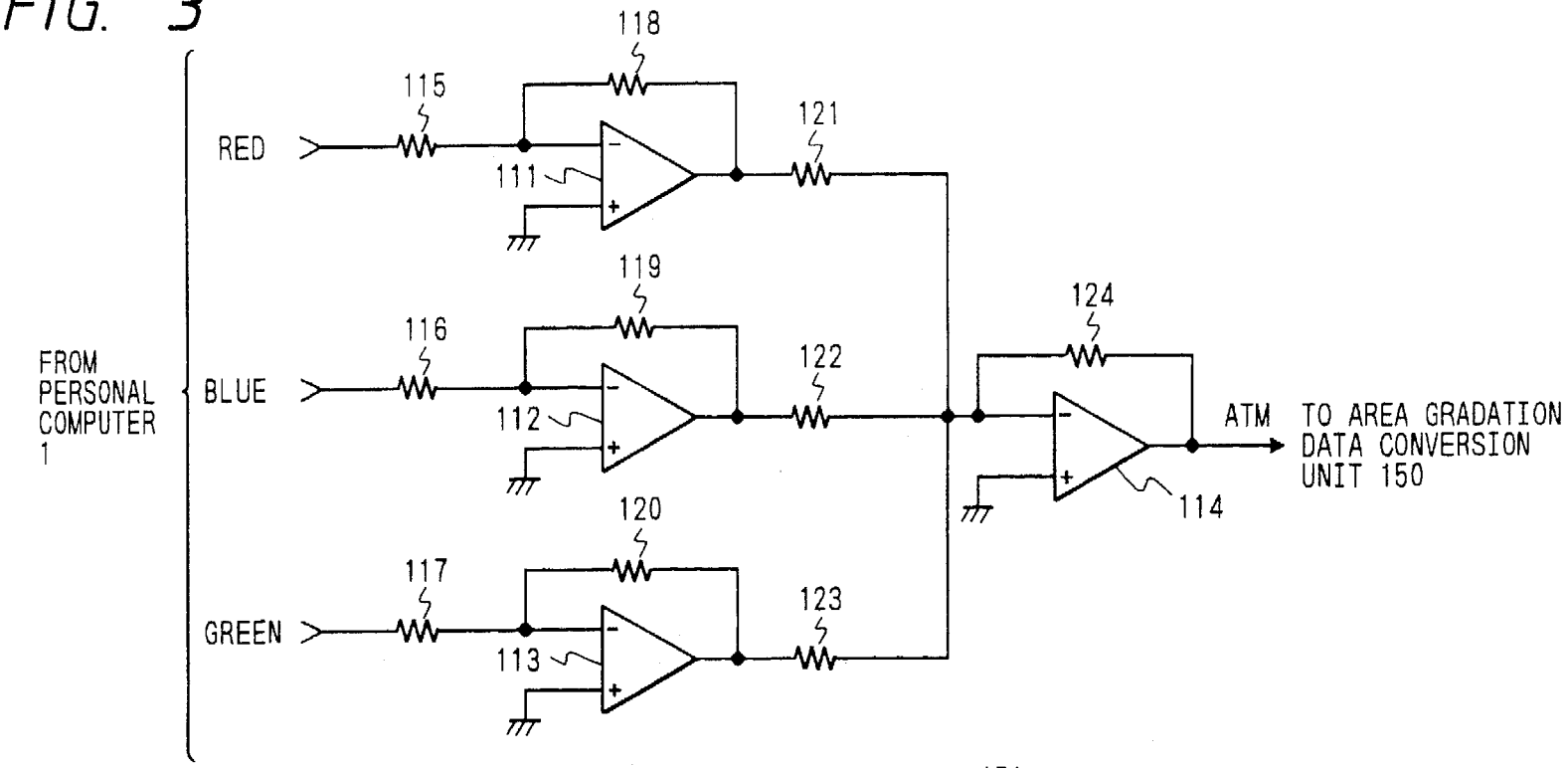
FIG. 3 is a circuit diagram of the analog arithmetical operation unit used in the present invention.

Referring to FIG. 2, red (R), green (G), and blue (B) signal weighting units 101, 102, and 103 weight R, G, and B signals. A signal adder 104 adds the analog signals weighted by the red, green, and blue signal weighting units 101, 102, and 103. An actual circuit is constituted by resistors 115 to 117 and 121 to 124, and operational amplifiers 111 to 113 and 114 in FIG. 3. The resistors 115 to 124 are resistors for calculating multiplication and addition ratios. In order to calculate the conversion formula described above in this analog arithmetical operation unit, a formula between the resistors is established as follows: [{(RED Voltage Value)×(Value of Resistor 118)/(Value of Resistor 115)}×{(value of Resistor 124)/(Value of Resistor 121)}+{(GREEN Voltage Value)×(Value of Resistor 119)/(Value of Resistor 116)}×{(Value of Resistor 124)/(Value of Resistor 122)}+{(BLUE Voltage Value)×(Value of Resistor 120)/(Value of Resistor 117)}×{(Value of Resistor 124)/(Value of resistor 123)}]. In order to realize this formula, for example, assume that the value of the resistor 118 is set to 1 kΩ, the value of the resistor 119 is set to 2 kΩ, the value of the resistor 120 is set to 500 Ω, the values of the resistors 115, 116, and 117 are set to 1 kΩ, and the values of the resistors 121, 122, 123, and 124 are set to 1 kΩ. Under these conditions, the addition of weighted values is performed: [(RED Signal Value)×1+(GREEN Signal Value)×2+(BLUE Signal Value)×0.5]. In this embodiment, conversion is performed by the addition of the weighted values: [(RED Signal Value)×1+(GREEN Signal Value)×2+(BLUE Signal Value)×0.5]. The values of the respective resistors may be changed to change the weighting amounts. Alternatively, each resistor may be constituted by a variable resistor to linearly vary the weighting amount.

The calculation formula is based on ideal elements free from an offset voltage error of the operational amplifier, a noise voltage error of the operational amplifier, an error caused by matching time in the operational amplifier, and harmonic distortion caused by different phases of amplification stages of the IC at a high frequency in the operational amplifier, and relative errors of the values of the resistors which serve as the constants of the arithmetical operation. Of all the factors, as the error caused in the operational amplifier, the offset voltage error is caused by differences in base-emitter voltages of the transistor pair of the differential input stage but is known to be reduced by trimming the resistors constituting the differential input stage. The noise voltage or current error is mainly caused by a transistor and can be improved by using a low-noise transistor. The matching time can be shortened in sufficient consideration of an arrangement using a high-speed transistor. A voltage feedback operational amplifier which performs matching within a period between ten and twenty nS within an error of 0.1% of 2 V so as to obtain a gain of −1 is known. The harmonic distortion can be reduced by phase correction by a capacitive passive element when the distortion is caused by the phase differences of the respective amplification stages. If relative errors between the resistors are identical, they can be reduced by arranging the resistors on a single substrate. However, since an error occurs between the elements having different values, it is possible to obtain necessary precision by trimming the resistors.

In this embodiment, pixel arrangements of the display device are "2 bit/pixel", "4 bit/pixel", and "8 bit/pixel" arrangements. If the number of gradation or hue levels required for area gradation or pixel division color display is assumed to be 256, the arithmetical operation precision required is 1/256 (about 0.4%) when the errors in the area gradation data conversion unit 150 are neglected. A signal AIM calculated by this block is supplied to the area gradation data conversion unit 150.

(3.2) Area Gradation Data Conversion Unit

Figure 4:
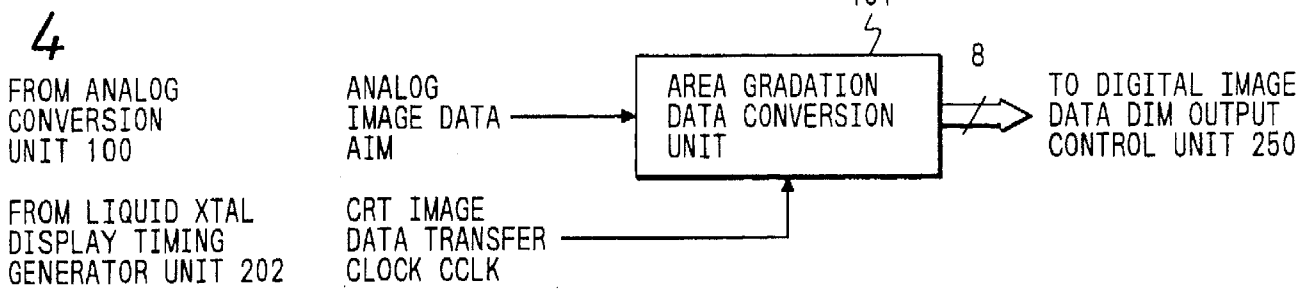
FIG. 4 is a block diagram of an area gradation data conversion unit used in the present invention.
Figure 5:
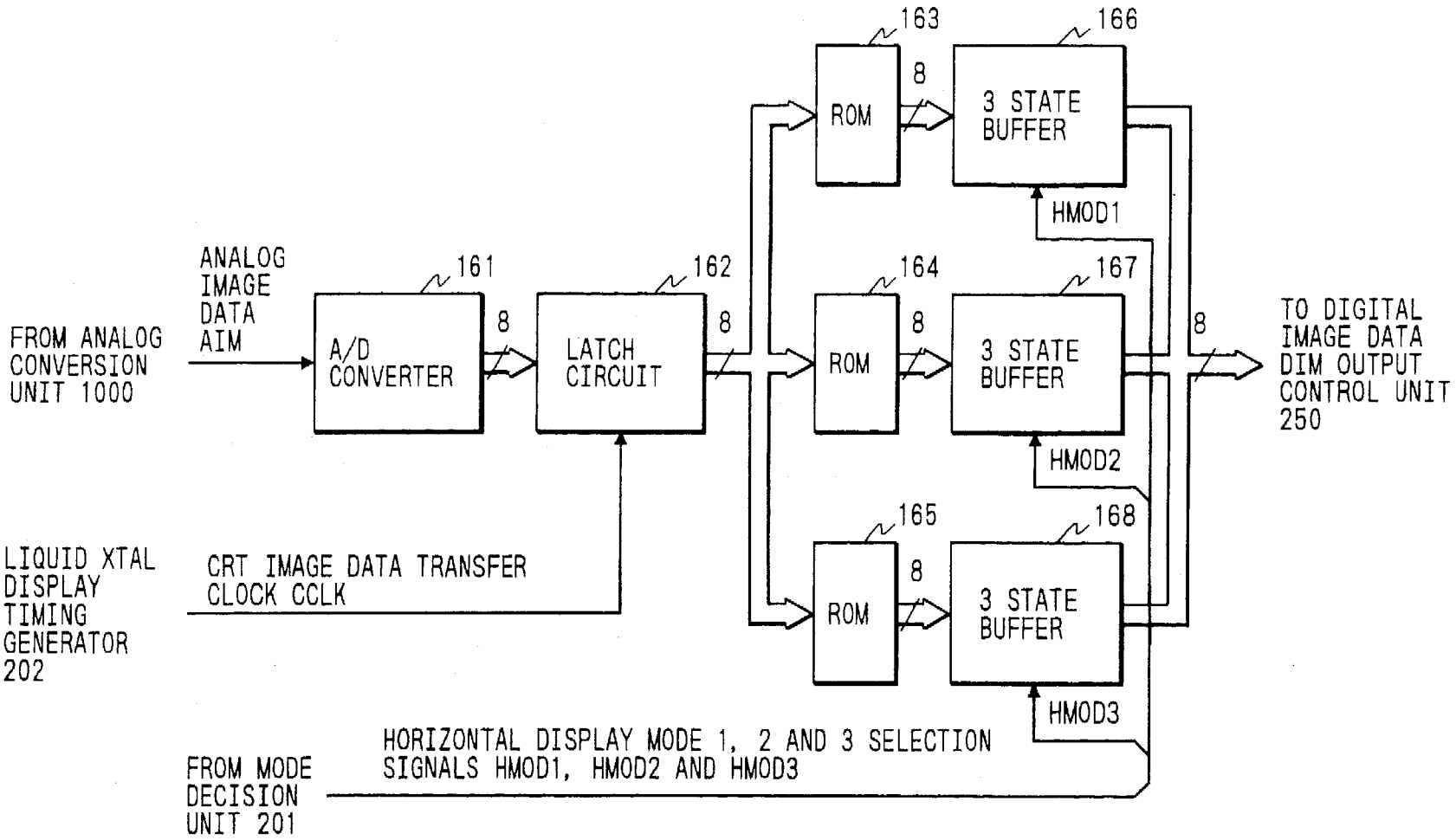
FIG. 5 is a block diagram of an A/D conversion circuit.

FIG. 4 shows an area gradation data conversion unit 151 for supplying the digital image data DIM for performing control in the discrete system from the continuous system. The analog image data AIM from the analog conversion unit 100 described in (3.1) is supplied to the area gradation data conversion unit 151. The area gradation data conversion unit 151 converts the analog image data AIM into the pixel data DIM for the ferroelectric LC display unit 340 operated by area gradation using the signal AIM. The data DIM is supplied to the output control unit 250. Area gradation data conversion must be performed at the period of the CRT image data transfer clock CCLK (25.175 MHz) supplied from the CRT control signal conversion control unit 200. As shown in FIG. 5, an A/D converter 161 constituting this block must be operated to obtain an 8-bit data width suitable for the "8 bit/pixel" at a timing suitable for this transfer rate. Conversion methods capable of operating at this conversion rate are perfect parallel type control, serial/parallel control, and A/D conversion control. In the perfect parallel type control, an 8-bit data width and a conversion rate of about 30 MHz can be obtained in complementary metal oxide film silicon (to be referred to as CMOS hereinafter). An 8-bit data width and a conversion rate of several hundreds of MHz can be achieved in an emitter coupled logic (to be referred to as an ECL hereinafter). A CMOS integrated circuit can be manufactured more simply than the ECL, and the peripheral circuit section of the CMOS integrated circuit can be arranged more easily than those of the ECL. In this embodiment, the A/D converter 161 comprises a CMOS integrated circuit. Precision of this A/D converter is determined in accordance with errors of the resistor ladder consisting of $2^8$ resistors and the presence/absence of error factors of $2^7$ comparators. In particular, When a CMOS arrangement is used in the comparator, a threshold voltage error thereof and 1/f noise adversely affect the precision of the converter. In this embodiment, a reference voltage supplied to the A/D converter 161 is set such that a full-scale value of a digital code is output in response to a maximum analog input voltage. In this case, a 1-bit weighting voltage of the A/D converter 161 is given as about 13.7 mV, i.e., a value obtained by dividing the solution of the conversion formula for the analog R, G, and B signals, that is, 1 V+2 V+0.5 V=3.5 V, by 256. From statistic considerations, 3δ which is three times a standard deviation δ of the above errors is set to be smaller than 13.7 mV. The precision of the display control apparatus 50 must be evaluated by a value added with the errors of the analog arithmetical operation unit 100 and the area gradation data conversion unit 150. In this embodiment, since the voltage feedback operational amplifier having excellent linear characteristics and resistors having small errors in absolute values are used, errors in the analog arithmetical operation unit 100 are very small.

The circuit of the area gradation data conversion unit 150 will be described in detail.

(3.2.1) Circuit Arrangement of Data Conversion Unit

Figure 6:
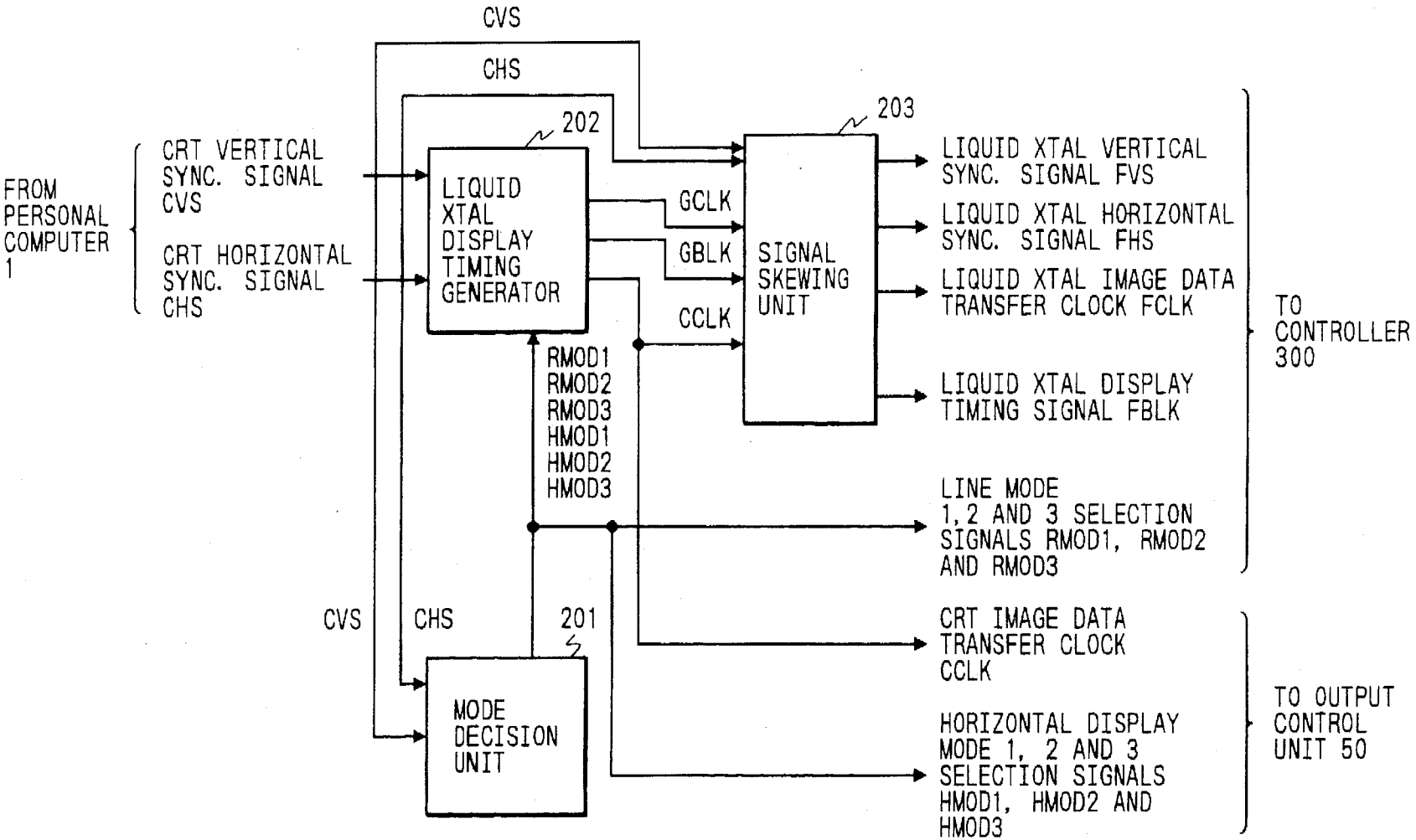
FIG. 6 is a block diagram of a CRT control signal conversion control unit used in the present invention.
Figure 20:
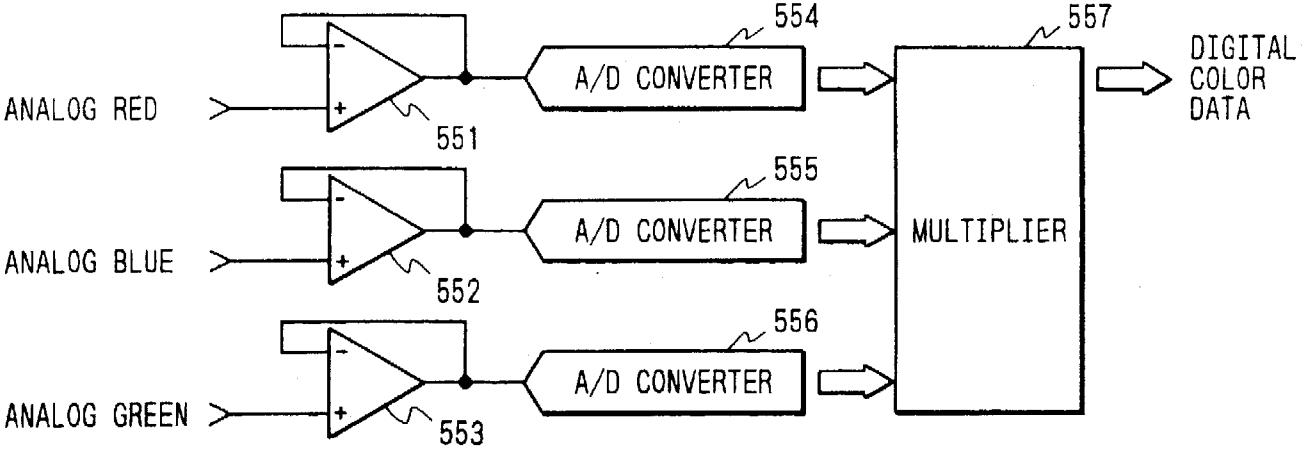
FIG. 20 PRIOR ART
FIG. 20 is a block diagram of a conventional analog RGB signal conversion arithmetical operation unit.
Figure 21:
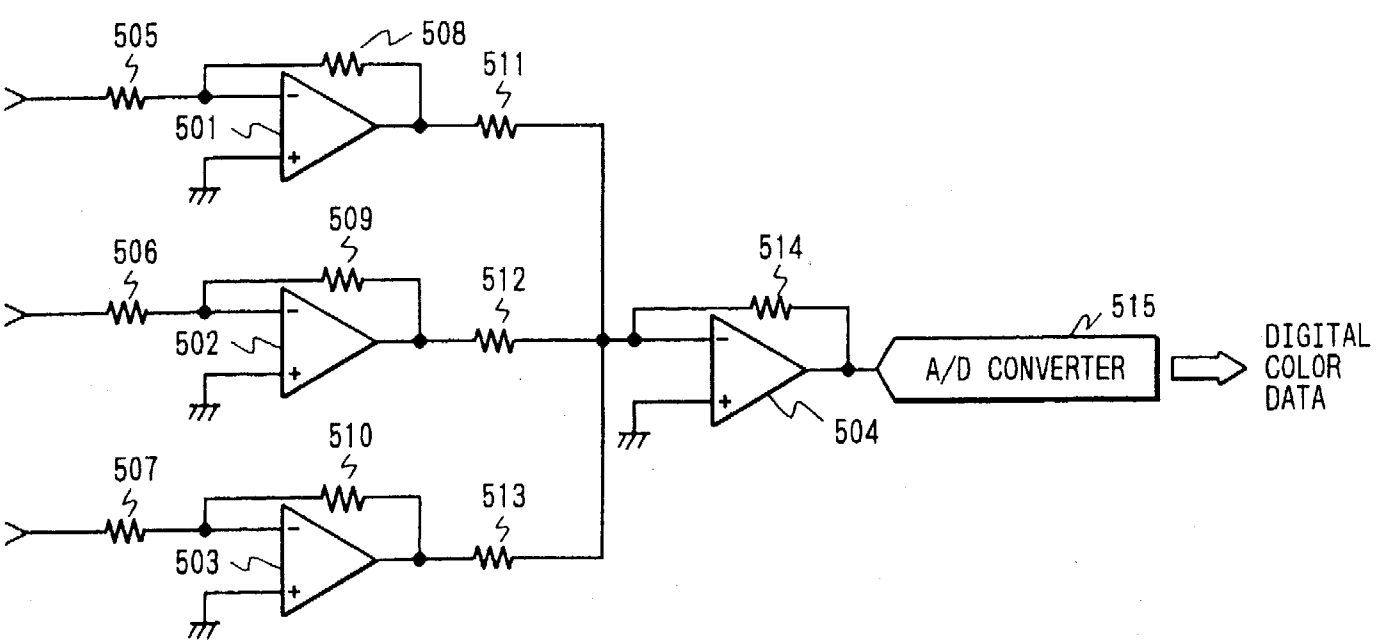
FIG. 21 is a block diagram of an analog RGB conversion unit used in the present invention.
Figure 22:
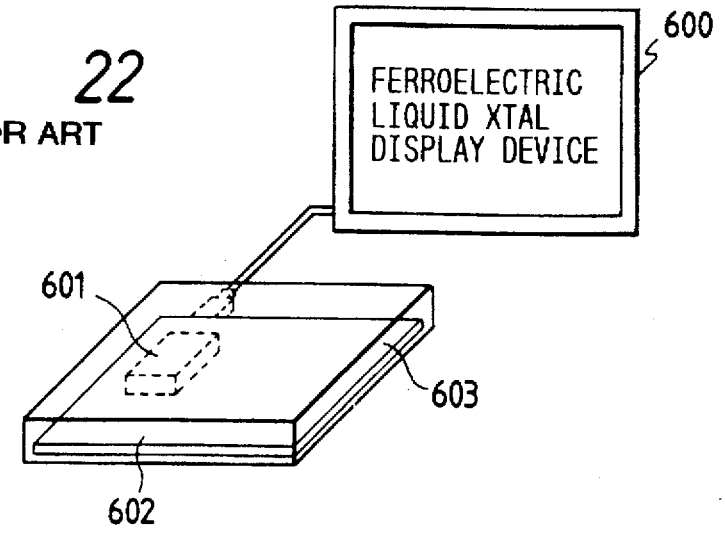
FIG. 22 PRIOR ART
FIG. 22 is a diagram used for explaining a conventional case in which a liquid crystal display control apparatus is arranged on a mother board.
Figure 23:
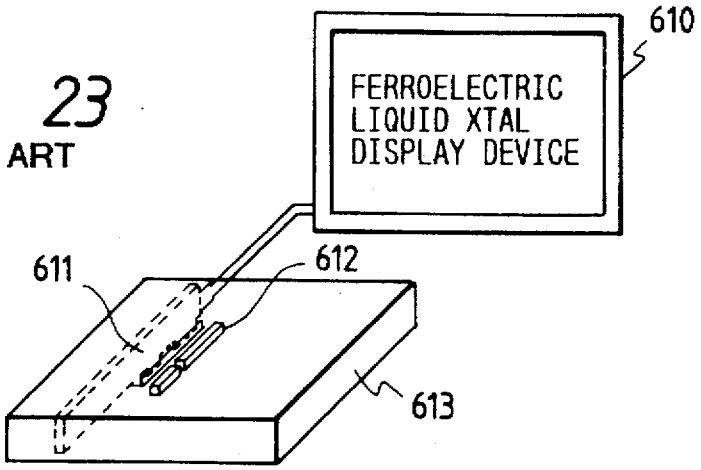
FIG. 23 PRIOR ART
FIG. 23 is a diagram used for explaining a conventional case in which the liquid crystal display control apparatus is mounted on an expansion slot.
Figure 24:
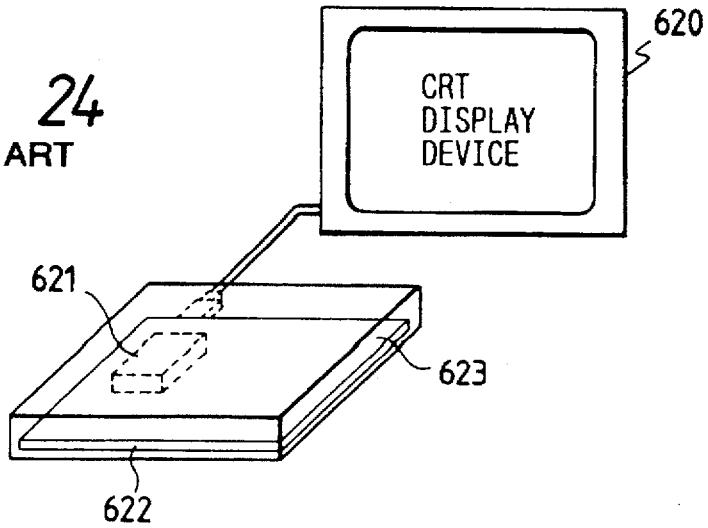
FIG. 24 PRIOR ART
FIG. 24 is a diagram used for explaining a conventional case in which a CRT display control apparatus is mounted on a mother board.

FIG. 5 shows an A/D conversion circuit. The A/D converter 161 converts the analog image data AIM supplied from the analog arithmetical operation unit 100 into the digital data DIM. The converted data is held by a latch circuit 162 at the leading edge of the CRT image data transfer clock CCLK supplied from a liquid crystal display timing generator 202 (FIG. 6). The upper bits of the area gradation data DIM supplied from the latch circuit 162 are used as address data for ROMs 163, 164, and 165 to read out data, and the readout data is supplied to the output control unit 250 (FIG. 1) from a 3 state buffer 166, 167, or 168 selected by a horizontal mode 1 selection signal HMOD1, a horizontal mode 2 selection signal HMOD2, or a horizontal mode 3 selection signal HMOD3 supplied from a mode decision unit 201. The contents of the ROM 164 for the "4 bit/pixel" arrangement are shown in FIG. 20.

(3.3) Conversion Unit for Converting CRT Control Signal into Ferroelectric Liquid Crystal Control Signal FIG. 6 shows an arrangement of the CRT control signal conversion control unit 200. In this embodiment, a mode decision unit 201 is arranged to discriminate many modes of the PC 1. The mode decision unit 201 decides the display line number in accordance with the polarities of the CRT vertical sync signal CVS and the CRT horizontal sync signal CHS supplied from the PC 1, as shown in FIG. 17. A liquid crystal display timing generator 202 causes a phase detector 220 (FIG. 8) to compare the phase of the CRT horizontal sync signal CHS supplied from the PC 1 with the phase of a frequency-divided signal of the 25.175-MHz CCLK oscillated by a voltage-controlled oscillator (VCO) 222. The liquid crystal display timing generator 202 generates a CRT image data transfer clock CCLK phase-locked with the CRT horizontal sync signal CHS. In this embodiment, image data-is transferred from the PC 1 at a transfer rate of 28.322 MHz in modes 2+, 3+, and 7+, 14.161 MHz in modes 0+and 1+, 12.588 MHz in modes 4, 5, D, and 13, and 25.175 MHz in other modes. When all the modes are sampled and converted at a frequency of 25.175 MHz, the modes 2+, 3+, and 7+ in the horizontal 720-pixel display mode are thinned to obtain 640 pixels. Image data is interpolated in the horizontal 360-pixel display modes 0+ and 1+ to obtain 640 pixels. The horizontal 320-pixel display modes 4, 5, D, and 13 are interpolated to obtain 640-pixel data. Other modes are sampled and converted at a frequency of 25.175 MHz, so that image data consisting of 640 display pixels in the horizontal direction is output. The selection signal HMOD2 of the signals HMOD1, HMOD2, and HMOD3 is enabled regardless of the types of modes. The CRT image data transfer clock CCLK is frequency-divided to generate a produced image data transfer clock GCLK. This clock GCLK is supplied to a signal skewing unit 203. Since the signal skewing unit 203 combines the phases of the liquid crystal display image data FDAT, the liquid crystal display timing signal FBLK, the liquid crystal vertical sync signal FVS, the liquid crystal display horizontal sync signal FHS, and the liquid crystal image data transfer clock FCLK, the "N bit/pixel" output is delayed by N clocks (CRT image data transfer clock CCLK).

The CRT control signal conversion control unit 200 will be described in detail.

(3.3.1) Circuit Arrangement of Mode Decision Unit

Figure 7:
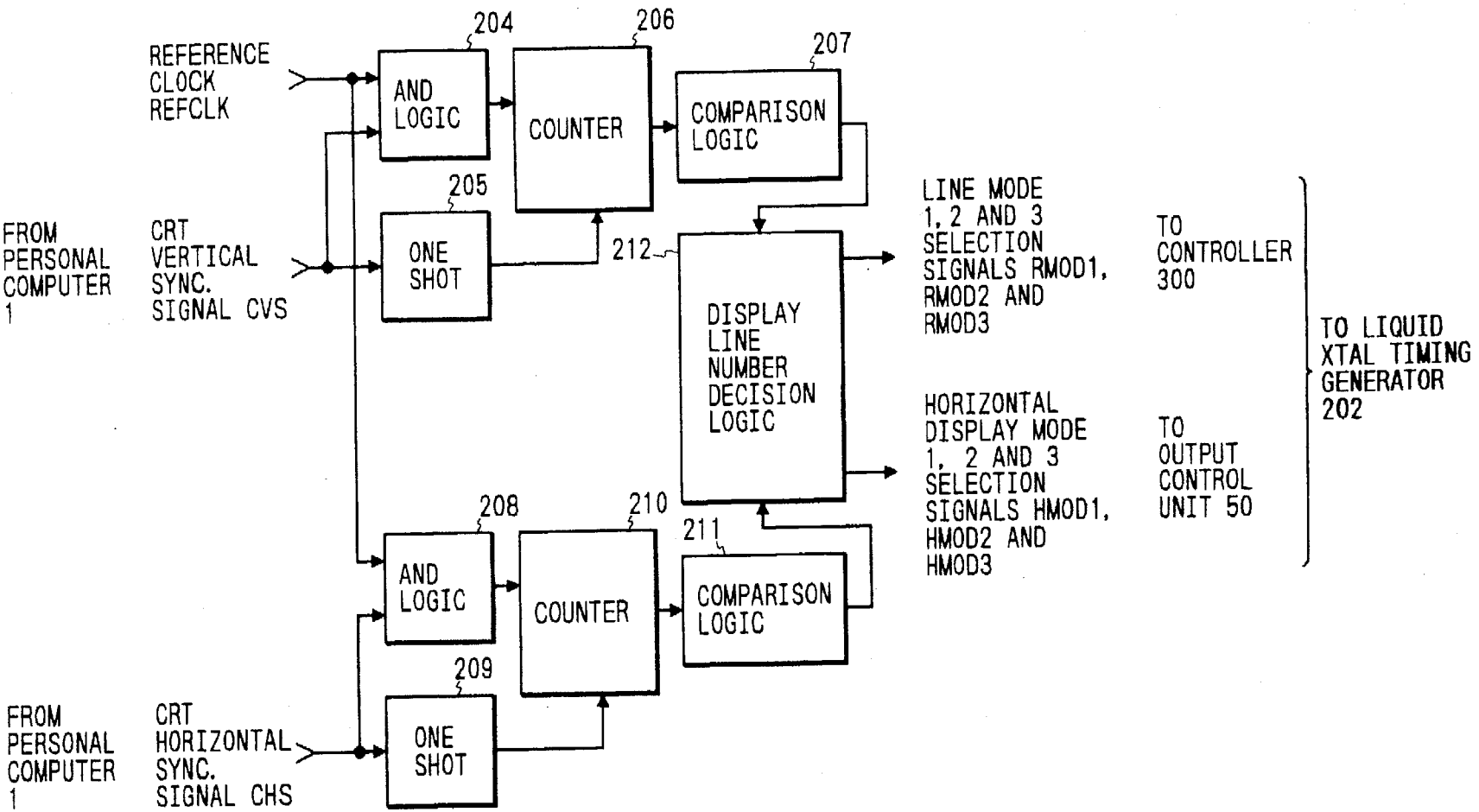
FIG. 7 is a block diagram of a mode decision unit used in the present invention.

FIG. 7 shows the arrangement of the mode decision unit 201. A gate 204 is enabled for the positive duration of one period of the CRT vertical sync signal CVS supplied from the PC 1 to provide reference clocks REFCLK to be counted by a counter 206. A one shot multivibrator 205 generates a signal for resetting the counter 206 every period of the CRT vertical sync signal CVS. A comparison logic 207 compares the count value of the counter 206 with a predetermined value to decide the polarity of the CRT vertical sync signal CVS. A circuit constituted by an AND logic 208, a one shot multivibrator 209, a counter 210, and a comparison logic 212 similarly decides the polarity of the CRT horizontal sync signal CHS. A display line number decision logic 212 decides the mode of the display lines (FIG. 17), i.e., the display line number from the polarities of both the sync signals CVS and CHS. A digital logic circuit 212 decides the mode in accordance with the display line information and generates the line mode 1 selection signal RMOD1 representing 350 display lines, the line mode 2 selection signal RMOD2 representing 400 display lines, or the line mode 3 selection signal RMOD3 representing 480 display lines. The signal RMOD1, RMOD2 or RMOD3 is supplied to a vertical sync frontporch programmable counter 225 (FIG. 8) and a vertical sync backporch programmable counter 226. In this embodiment, since the number of horizontal display pixels is defined as 640, the horizontal display mode 2 selection signal HMOD2 of the horizontal display mode 1 selection signal HMOD1, the horizontal display mode 2 selection signal HMOD2, and the horizontal display mode 3 selection signal HMOD3 is enabled regardless of the types of CRT modes.

(3.3.2) Circuit Arrangement of Liquid Crystal Display Timing Generator

Figure 8:
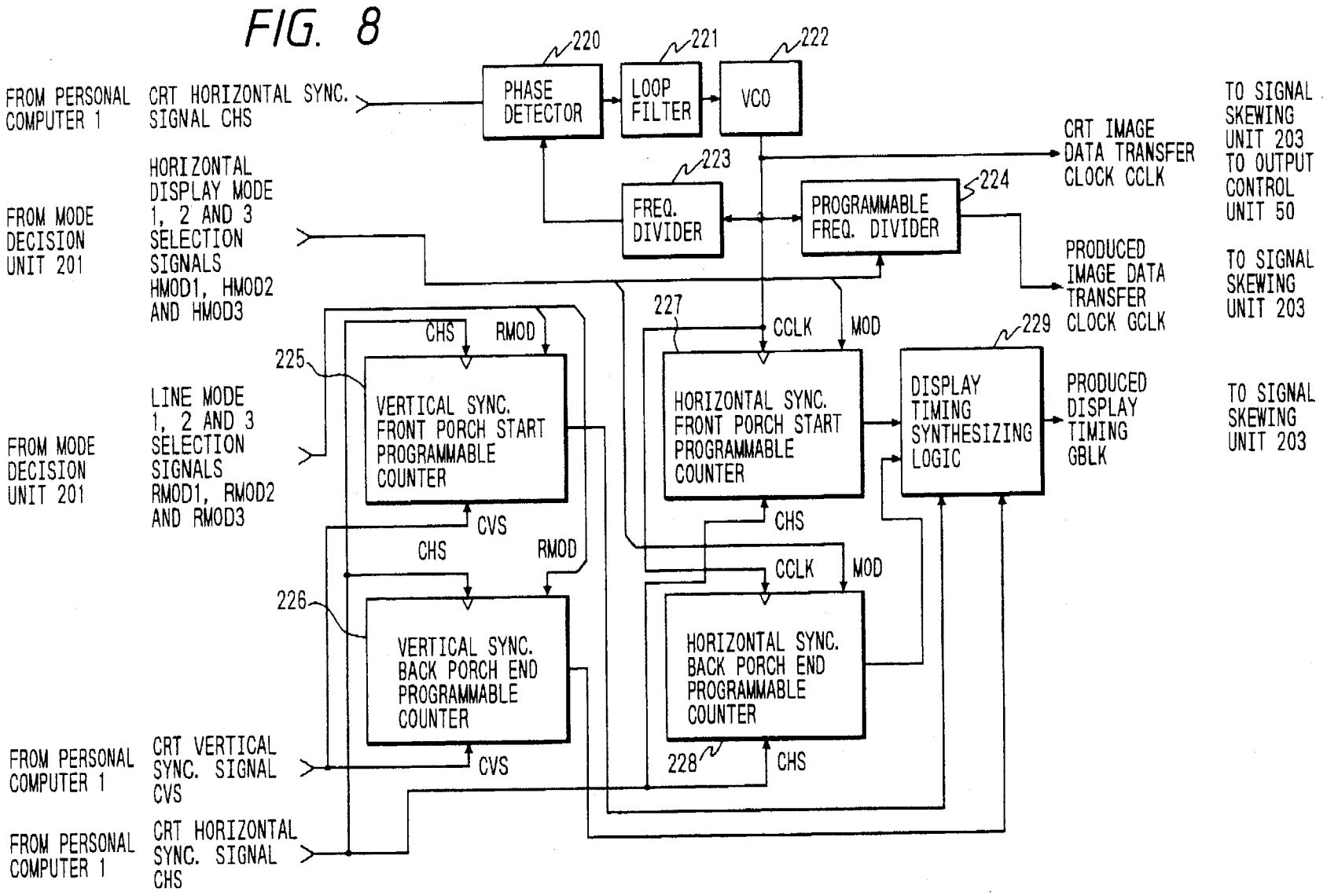
FIG. 8 is a block diagram of a liquid crystal display timing generator.

FIG. 8 shows the arrangement of the liquid crystal display timing generator 202. The phase detector 220 detects a phase difference between the CRT horizontal sync signal CHS from the PC 1 and the clock signal obtained by causing a frequency divider 223 to frequency-divide the signal from the VCO 222. The frequency divider 223 is set such that an output from the VCO 222 has a frequency of 25.175 MHz and the frequency-divided component has the same period as that of the sync signal CHS. The clock singal as the CRT image data transfer clock CCLK is supplied to the signal skewing unit 203 (FIG. 6) and the output control unit 250 (FIG. 1). The frequency divider 223 frequency-divides the clock signal CCLK into ½, ¼, and ⅛ signals in accordance with the horizontal display mode 1 selection signal HMOD1, the horizontal display mode 2 selection signal HMOD2, or the horizontal display mode 3 selection signal HMOD3 from the mode decision unit 201. The frequency-divided clock signals as the produced data transfer clocks GCLK are supplied to the signal skewing unit 203. The counters 225 and 226 produce a time interval from the start of the frontporch to the end of the backporch, i.e., the line display time interval. The counters 225 and 226 count down the programmed values in response to the CRT horizontal sync signal CHS in accordance with the line mode 1 selection signal RMOD1, the line mode 2 selection signal RMOD2, or the line mode 3 selection signal RMOD3. In this embodiment, the values selected by the line mode 1 selection signal RMOD1, the line mode 2 selection signal RMOD2, or the line mode 3 selection signal RMOD3, as shown in FIG. 18 are set in the counters 225 and 226. The counters 225 and 226 generate non-display signals before and after the CRT vertical sync signal CVS supplied from the PC 1. Values shown in FIG. 18 are set in counters 227 and 228 in accordance with mode selection signals MOD. The counters 227 and 228 count down the CRT display data transfer clocks CCLK and generate non-display signals before and after the CRT horizontal sync signal CVS supplied from the PC 1. The produced display timing clock GBLK is produced by logically synthesizing the non-display signals by a display timing synthesizing logic 229. The clock GBLK is supplied to the signal skewing unit 203.

(3.3.3) Circuit Arrangement of Signal Skewing Unit

Figure 9:
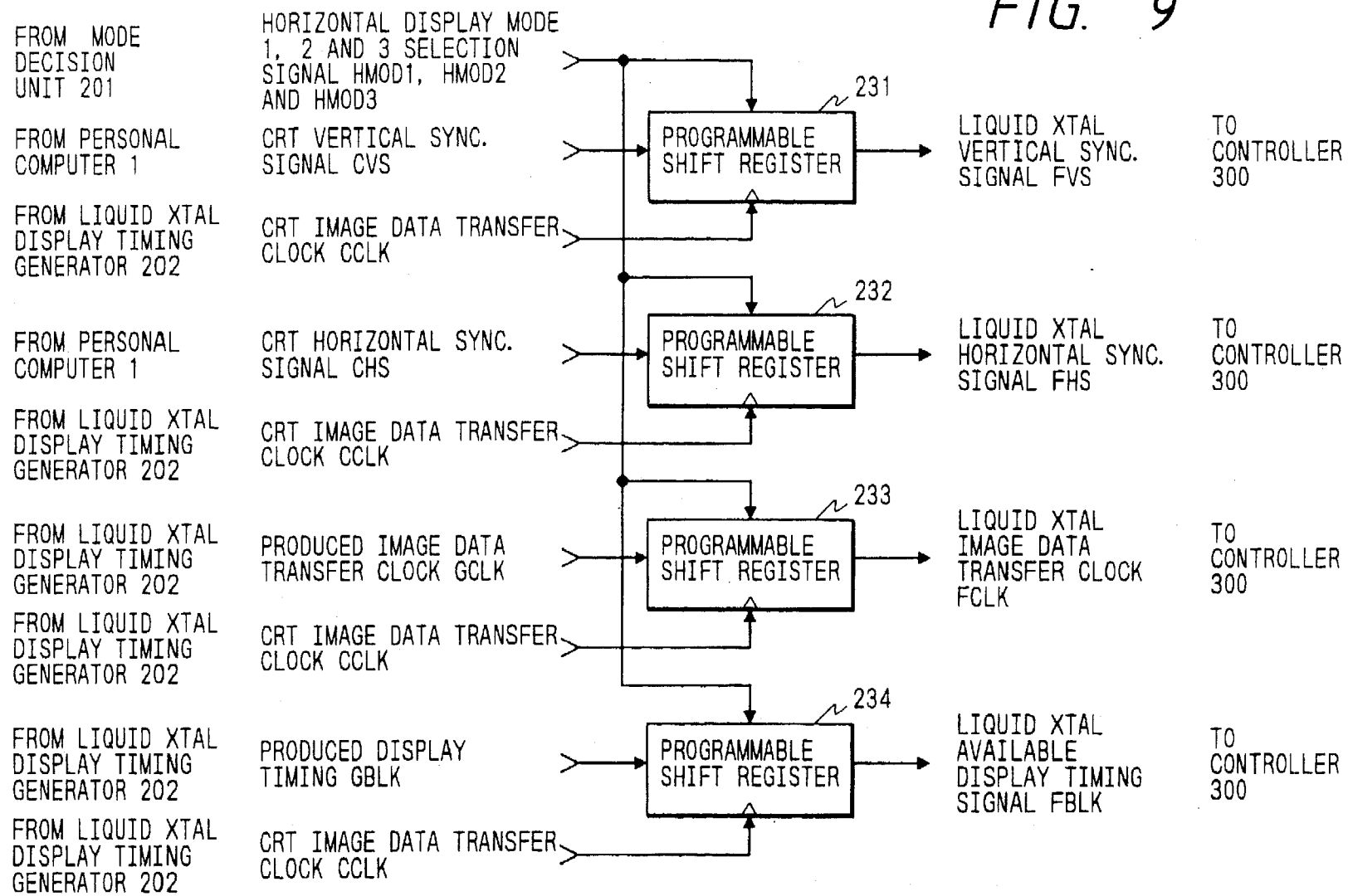
FIG. 9 is a block diagram of a signal skewing unit used in the present invention.

FIG. 9 shows the circuit of the signal skewing unit. Programmable shift registers 231 to 234 delay the, FVS, FHS, FCLK, and FBLK signals. An N-clock delay is programmed in each programmable shift register in accordance with the mode 1 selection signal MOD1, the mode 2 selection signal MOD2, or the mode 3 selection signal MOD3. Outputs from the programmable shift registers 231 to 234, the liquid crystal vertical sync signal FVS, the liquid crystal horizontal sync signal FHS, the liquid crystal image data transfer clock FCLK, and the liquid crystal display timing signal FBLK are supplied to the controller 300. The controller 300 performs setup of the drive voltage and displaying of the no interface or interface scanning on the basis of information from the thermo-sensor 330 to drive the common driver 320 and the segment driver 321 so as to perform a display operation on the display unit 340.

(3.4) Output Pixel Data Control Unit

Figure 14:
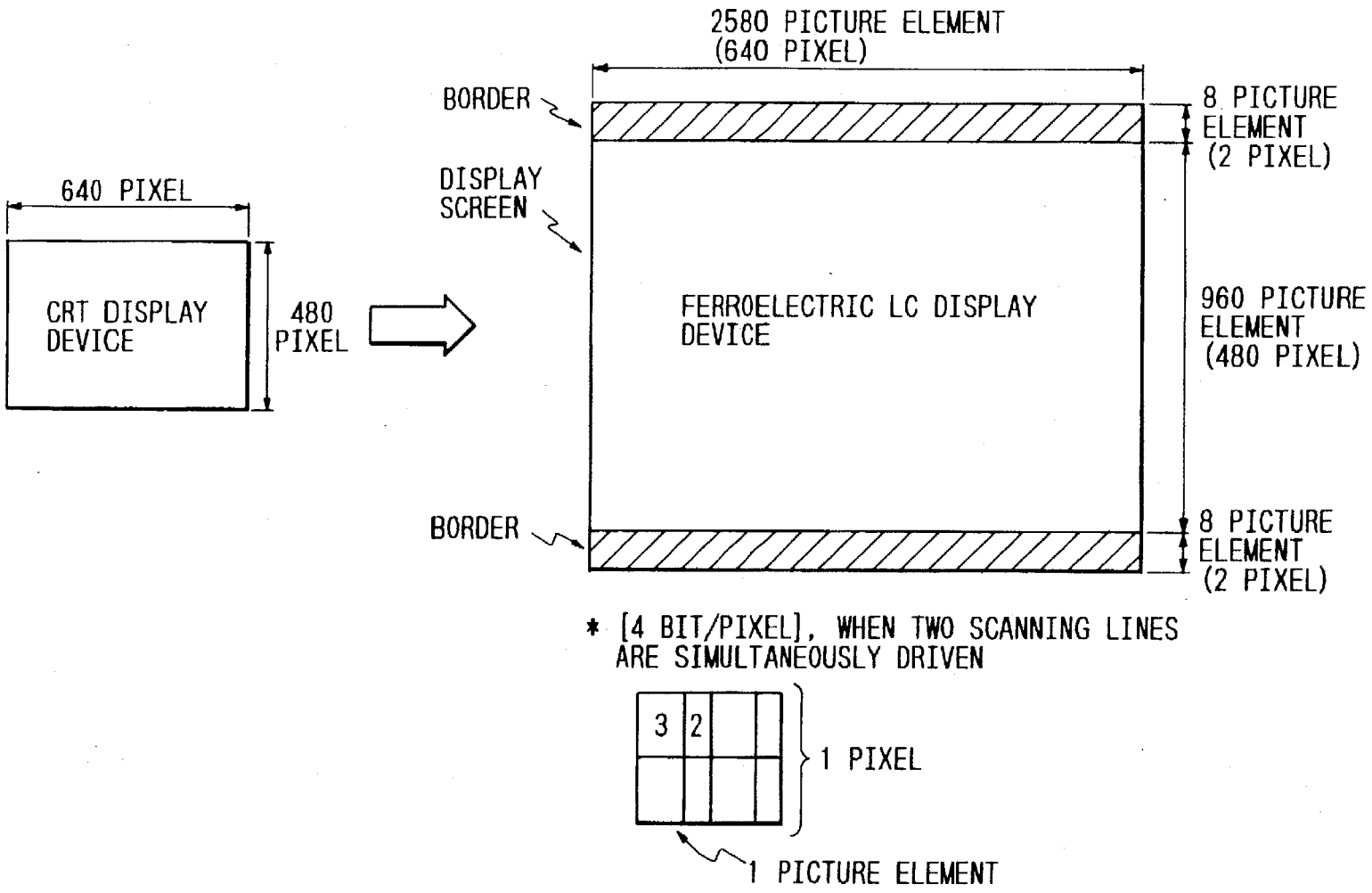
FIG. 14 is a diagram used for explaining a pixel structure used in the present invention.

Referring to FIG. 10, the output control unit 250 is constituted by control blocks as a "2 bit/pixel" output unit 251, a "4 bit/pixel" output unit 252, and an "8 bit/pixel" output unit 253. In the control unit 250, a data output from one of the control blocks is selected in accordance with the horizontal display mode 1 selection signal HMOD1, the horizontal display mode 2 selection signal HMOD2, or the horizontal display mode 3 selection signal HMOD3 supplied from the CRT control signal conversion control unit 200. The image data FDAT in the selected "bit/pixel" form is supplied to the display controller 300 in units of 16 bits. The above selection is associated with the number of horizontal display pixels. For example, when a display operation is to be performed in accordance with the number of horizontal bits in an available display area 351 (FIG. 1), the "2 bit/pixel" output unit 251 can appropiately display on the display unit 340 in displaying an image having 1,280 horizontal pixels. The "4 bit/pixel" output unit 252 can appropriately display on the display unit 340 in displaying an image having 640 horizontal pixels (FIG. 14). The "8 bit/pixel" output unit 253 can appropriately display on the display unit 340 in displaying an image having 320 horizontal pixels. The number of display lines in the vertical direction can correspond to 1, 2, or 4 scanning lines simultaneously displayed on the display unit 340 by supplying the line mode 1 selection signal RMOD1, the line mode 2 selection signal RMOD2, or the line mode 3 selection signal RMOD3 to the controller 300.

Three output control units will be described in detail below.

(3.4.1) Circuit Arrangement of "2 Bit/Pixel" Output Unit

Figure 11:
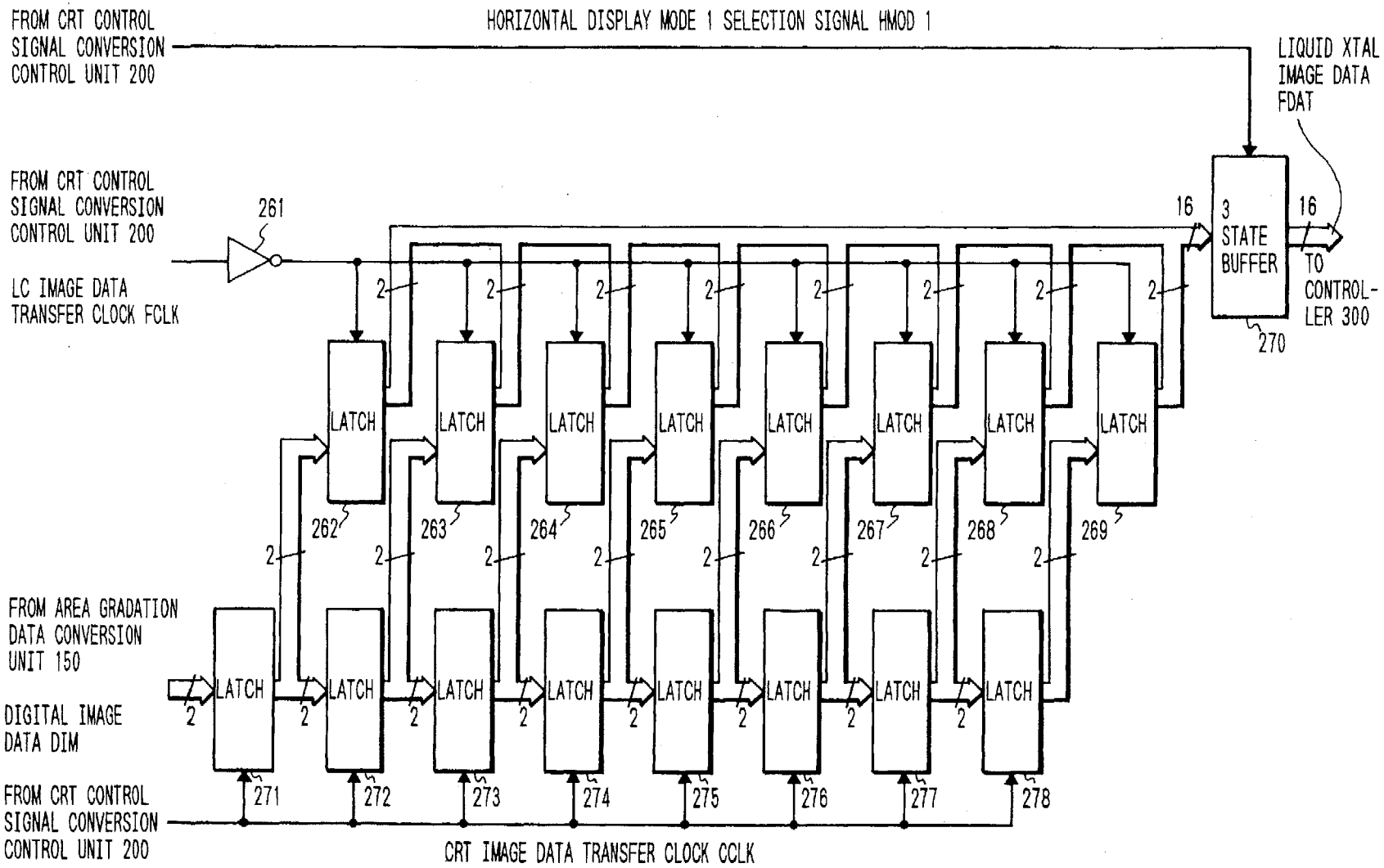
FIG. 11 is a circuit diagram of a 2 bit/pixel output unit used in the present invention.

FIG. 11 shows the "2 bit/pixel" output unit 251 (FIG. 10). Latch circuits 271 to 278 are registers for sequentially shifting two lower bits of the digital image data DIM supplied from the area gradation data conversion unit 150 in response to the CRT image data transfer clock CCLK from the CRT control signal conversion control unit 200. Latch circuits 262 to 269 hold eight "2 bit/pixel" data at a leading edge of a signal obtained by inverting the liquid crystal image data transfer clock FCLK from the CRT control signal conversion control unit 200 through an inverter 261. The held data are supplied as the liquid crystal image data FDAT to the controller 300 from a 3 state buffer 270 controlled by the horizontal display mode 1 selection signal HMOD1 supplied from the CRT control signal conversion control unit 200. When a high-definition display operation having 640 or more horizontal CRT pixels is to be performed, the "2 bit/pixel" arrangement is selected. In this embodiment, since the image data transferred at a frequency of 28.322 MHz from the graphic adapter in the PC 1 is sampled, converted, and thinned at a frequency of 25.175 MHz, which operation corresponds to the modes 2+, 3+, and 7+ of the horizontal display 720-pixel mode, the 640-pixel display operation is performed. In this embodiment, the output unit 251 is arranged as a supplementary means.

(3.4.2) Circuit Arrangement of "4 Bit/Pixel" Output Unit

Figure 12:
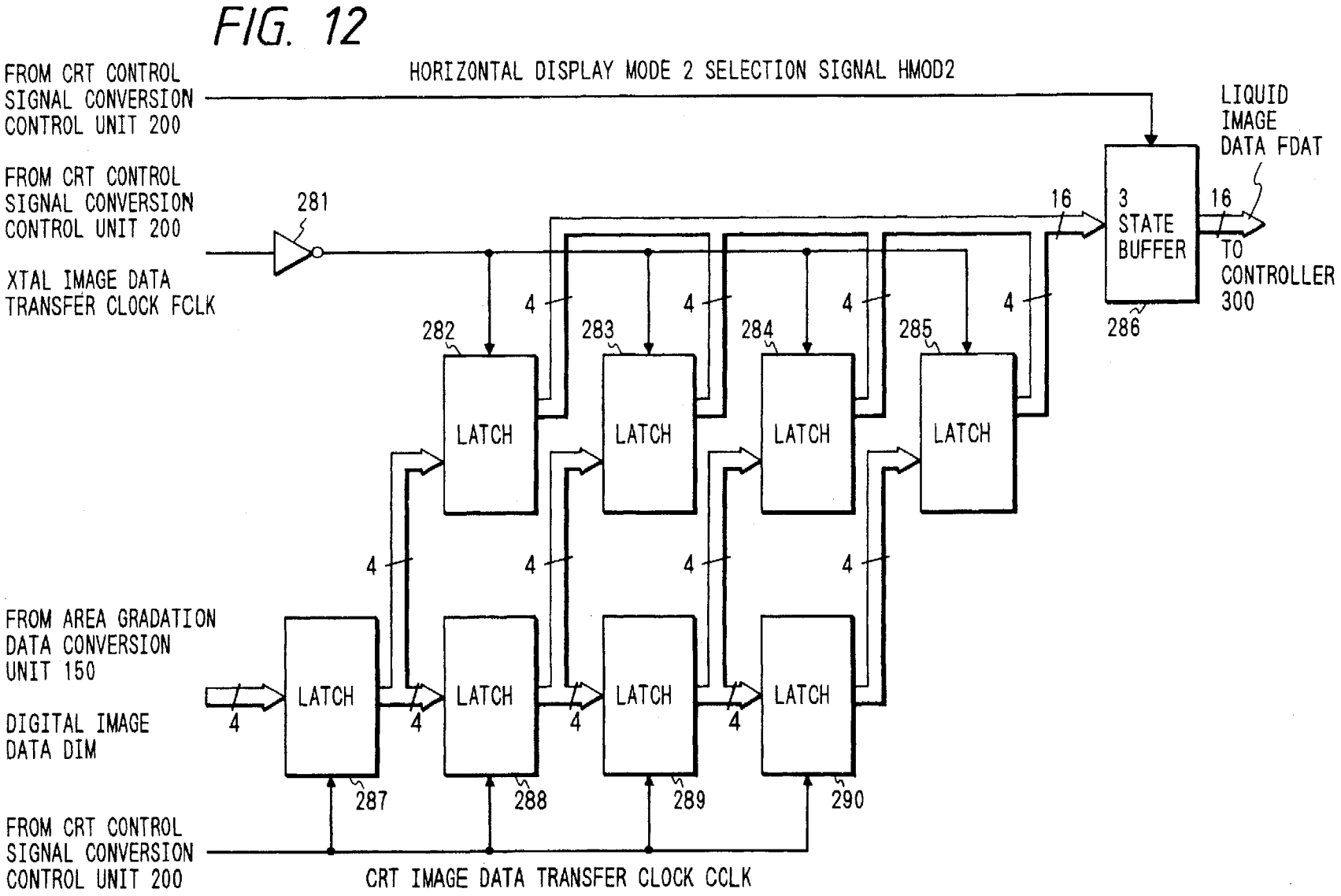
FIG. 12 is a circuit diagram of a 1 bit/pixel output unit used in the present invention.

FIG. 12 shows the "4 bit/pixel" output unit 252 (FIG. 10). Latch circuits 287 to 290 are registers for sequentially shifting four lower bits of the digital image data DIM supplied from the area gradation data conversion unit 150 in response to the CRT image data transfer clock CCLK from the CRT control signal conversion control unit 200. Latch circuits 282 to 285 hold four "4 bit/pixel" data at a leading edge of a signal obtained by inverting the liquid crystal image data transfer clock FCLK from the CRT control signal conversion control unit 200 through an inverter 281. The held data are supplied as the liquid crystal image data FDAT to the controller 300 from a 3 state buffer 286 controlled by the horizontal display mode 2 selection signal HMOD2 supplied from the CRT control signal conversion control unit 200. In this embodiment, the "4 bit/pixel" arrangement is selected in the modes 0+, 1+, 2+, 3+, 7+, 6, D, E, F, 10, 11, 12, and 13.

(3.4.3) Circuit Arrangement of "8 Bit/Pixel" Output Unit

FIG. 13 shows the "8 bit/pixel" output unit 253 (FIG. 10). Latch circuits 295 and 296 are registers for sequentially shifting eight lower bits of the digital image data DIM supplied from the area gradation data conversion unit 150 in response to the CRT image data transfer clock CCLK from the CRT control signal conversion control unit 200. Latch circuits 292 and 293 hold two "8 bit/pixel" data at a leading edge of a signal obtained by inverting the liquid crystal image data transfer clock FCLK from the CRT control signal conversion control unit 200 through an inverter 291. The held data are supplied as the liquid crystal image data FDAT to the controller 300 from a 3 state buffer 294 controlled by the horizontal display mode 3 selection signal HMOD3 supplied from the CRT control signal conversion control unit 200. The "8 bit/pixel" arrangement is selected for a multigradation display operation in which the number of horizontal CRT display pixels is 320 or less. In this embodiment, this arrangement corresponds to the modes 4, 5, D, and 13 of the horizontal display 320-pixel mode. Since the image data transferred from the graphic adapter in the PC 1 at a frequency of 12.588 MHz is sampled and converted, the 320-pixel display operation is performed. In this embodiment, the "8 bit/pixel" output unit is arranged as a supplementary means.

Figure 15:
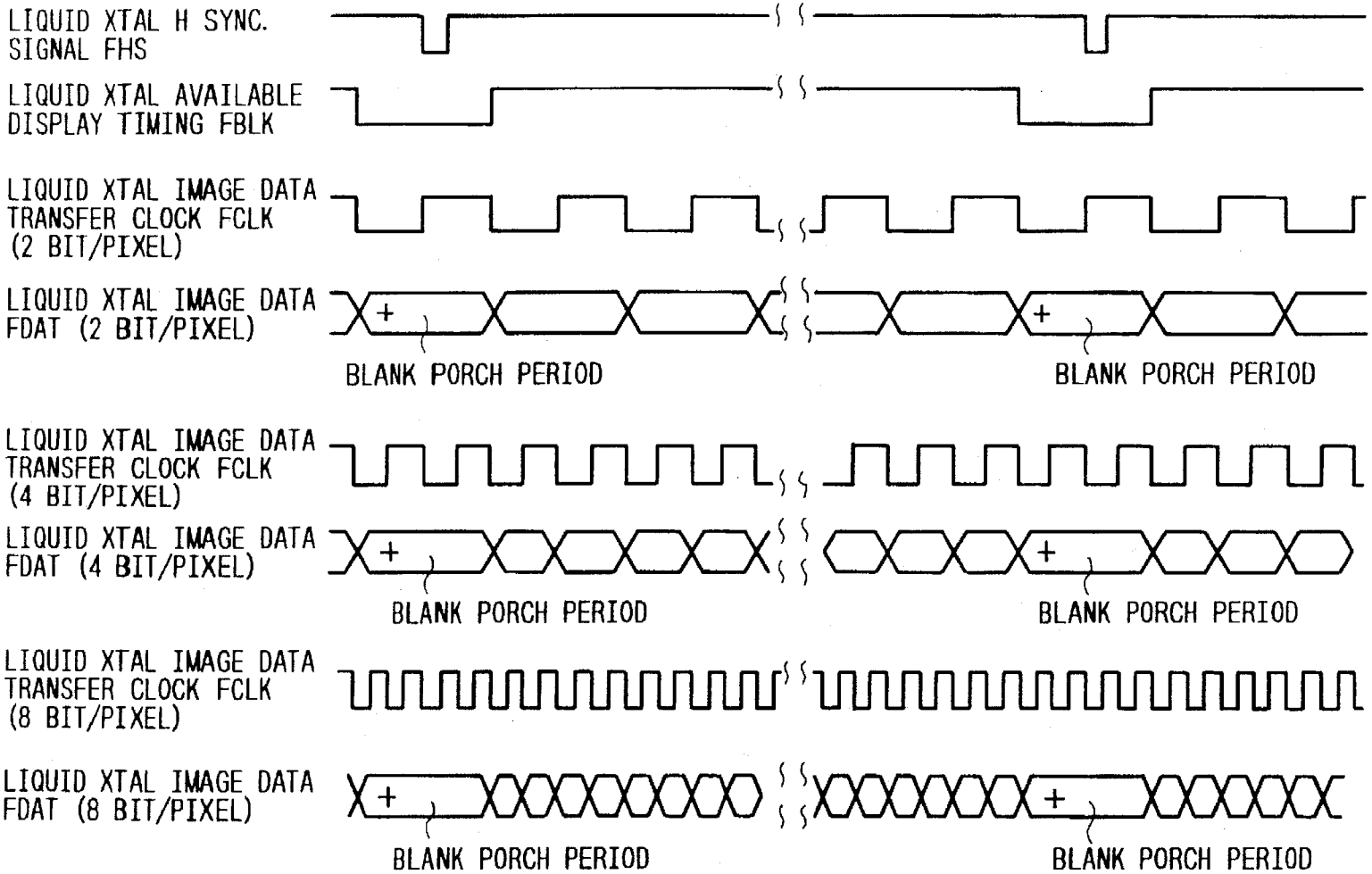
FIG. 15 is a timing chart of the main part of the output unit used in the present invention.

The main output timings of the respective blocks of the image data output control unit 250 are shown in FIG. 15.

(4) Modification (4.1) Gradation Conversion Unit

This embodiment exemplifies a technique for converting a continuous primary color signal into a discrete signal and controlling a data format suitably applied to area gradation used in a liquid crystal display having ferroelectric properties. However, when two blocks each consisting of an analog arithmetical operation unit and an area gradation data conversion unit may be used to perform signal conversion control having a higher-speed data transfer clock as in a WS. In this case, since the arithmetical operation unit requires a time (settling time) for matching the signals with rated precision, it is not effective to use it in a multiplex mode.

(4.2) Control Timing Generator

In this embodiment, the frequency division ratios of the frequency divider 223 (FIG. 8) are fixed. However, when a programmable frequency divider whose frequency division ratio can be variably set in accordance with an external signal such as a mode signal, the rate for converting the analog image data into the area gradation digital data is changed to arbitrarily interpolate or thin the image data. By the function described above, an arbitrary horizontal display size can be selected.

(4.3) Image Data Output Control Unit

In this embodiment, the data outputs are limited to the 2 bit/pixel output, the 4 bit/pixel output, and the 8 bit/pixel output. However, the data output may be an N bit/pixel. In addition, the data output may be a code representing a gradation level. A display area can be displayed in an optimal size on the display screen of the display device in accordance with the above output control. The numbers of displayable gradation levels and colors can be changed. When the size of the display screen is determined, the mode decision unit 201 (FIG. 6) and the like can be omitted, and the output from the output control unit 250 (FIG. 1) can be fixed to an "N bit/pixel" output.

By using the analog R, G, and B signals and the horizontal and vertical sync signals which are subjected to the "color palette+D/A conversion" which serves as a standard technique in the existing PC or WS, as described above, the image data from the PC or WS can be displayed in the ferroelectric liquid crystal display device having a large screen size without decreasing the contrast level. The display size and the number of gradation levels or colors can be arbitrarily set in accordance with a combination of the data conversion period and the output control unit [N bit/pixel]. The border areas in the right and left portions in the horizontal direction and the upper and lower portions in the vertical direction can be displayed outside the display area in an arbitrary size. Combination of control operations of output control units for expanding the display size to $2^n$ allows selection of an arbitrary number of gradation levels or colors in the liquid crystal display.

According to the present invention, when the display size is smaller than the available display screen of the display device, the border areas whose sizes in the vertical and horizontal directions are formed by a border area control means are generated, thereby controlling the display position.

What is claimed is:

1. A display control apparatus for controlling formation of an image on a display device having a plurality of scanning electrodes and a plurality of information electrodes disposed in a matrix and an effective display frame comprised of a plurality of dots each formed at an intersection of the scanning and information electrodes, said apparatus comprising:

a. sampling means for sampling a continuous system analog primary color signal to provide digital signal comprised of a plurality of pixels;

b. first selecting means for selecting one of at least two different display units for the display device so that a size of the image is optimized as displayed in the effective display frame, each display unit being defined by a respective different number of dots of the effective display frame per single pixel of the digital signal; and c. second selecting means for selecting, in accordance with the selected display unit, one of a plurality of predetermined sampling frequencies, where said sampling means uses the selected sampling frequency to sample the continuous system analog primary color signal.

2. A display control apparatus for controlling formation of an image on a display device having a plurality of scanning electrodes and a plurality of information electrodes disposed in a matrix and an effective display frame comprised of a plurality of dots each formed at an intersection of the scanning and information electrodes, said apparatus comprising:

a. sampling means for sampling a continuous system analog primary color signal to provide a digital signal comprised of a plurality of pixels and corresponding to gradation;

b. first selecting means for selecting one of at least two different display units for the display device so that a size of the image is optimized as displayed in the effective display frame, each display unit being defined by a respective different number of dots of the effective display frame per single pixel of the digital signal; and c. second selecting means for selecting, in accordance with the selected display unit, one of a plurality of predetermined sampling frequencies, where said sampling means uses the selected sampling frequency to sample the continuous system analog primary color signal.

3. A display control apparatus for controlling formation of an image on a display device having a plurality of scanning electrodes and a plurality of information electrodes disposed in a matrix and an effective display frame comprised of a plurality of dots each formed at an intersection of the scanning and information electrodes, said apparatus comprising:

a. sampling means for sampling a continuous system analog primary color signal to provide a digital signal comprised of a plurality of pixels and corresponding to gradation;

b. first selecting means for selecting one of at least two different display units for the display device so that a size of the image is optimized as displayed in the effective display frame, each display unit being defined by a respective different number of dots of the effective display frame per single pixel of the digital signal;

c. second selecting means for selecting, in accordance with the selected display unit, one of a plurality of predetermined sampling frequencies, where said sampling means uses the selected sampling frequency to sample the continuous system analog primary color signal; and d. the display device having the effective display frame for displaying the image in response to an input of the digital signal.

4. A display device having a plurality of scanning electrodes and a plurality of information electrodes disposed in a matrix and an effective display frame comprised of a plurality of dots each formed at an intersection of the scanning and information electrodes, said apparatus comprising:

a. sampling means for sampling a continuous system analog primary color signal to provide a digital signal comprises of a plurality of pixels;

b. first selecting means for selecting one of at least two different display units for the display device so that a size of the image is optimized as displayed in the effective display frame, each display unit being defined by a respective different number of dots of the effective display frame per single pixel of the digital signal;

c. second selecting means for selecting, in accordance with the selected display unit, one of a plurality of predetermined sampling frequencies, where said sampling means uses the selected sampling frequency to sample the continuous system analog primary color signal; and d. display means having the effective display frame for displaying the image in response to an input of the digital signal.

5. A display device having a plurality of scanning electrodes and a plurality of information electrodes disposed in a matrix and an effective display frame comprised of a plurality of dots each formed at an intersection of the scanning and information electrodes, said apparatus comprising:

a. sampling means for sampling a continuous system analog primary color signal to provide a digital signal comprised of a plurality of pixels;

b. first selecting means for selecting one of at least two different display units for the display device so that a size of the image is optimized as displayed in the effective display frame, each display unit being defined by a respective different number of dots of the effective display frame per single pixel of the digital signal;

c. second selecting means for selecting, in accordance with the selected display unit, one of a plurality of predetermined sampling frequencies, where said sampling means uses the selected sampling frequency to sample the continuous system analog primary color signal;

d. display means having the effective display frame for displaying the image in response to an input of the digital signal; and e. means for controlling said display means so that a border of the image is processed.

6. A device according to claim 5, wherein said display means comprises a ferroelectric liquid crystal panel.

* * * * *

UNITED STATES PATENT AND TRADEMARK OFFICE

CERTIFICATE OF CORRECTION

PATENT NO. : 5,742,261

DATED : April 21, 1998

INVENTOR(S) : OSAMU YUKI, ET AL.

It is certified that error appears in the above-identified patent and that said Letters Patent is hereby corrected as shown below:

COLUMN 1

Line 23, "exiting" should read --existing--.

COLUMN 8

Line 64, "data-is" should read --data is--.

COLUMN 10

Line 38, "the," should read --the--; and
Line 49, "scanning on" should read --scanning data on--.

COLUMN 11

Line 4, "appropiately" should read --appropriately--.

COLUMN 12

Line 33, "when" should be deleted.

UNITED STATES PATENT AND TRADEMARK OFFICE

CERTIFICATE OF CORRECTION

PATENT NO. : 5,742,261

DATED : April 21, 1998

INVENTOR(S) : OSAMU YUKI, ET AL.

It is certified that error appears in the above-identified patent and that said Letters Patent is hereby corrected as shown below:

COLUMN 13

Line 30, "digital" should read --a digital--.

Signed and Sealed this

Fifteenth Day of December, 1998

Bruce Lehman

*Attest:*

BRUCE LEHMAN

*Attesting Officer*

*Commissioner of Patents and Trademarks*